United States Patent [19]

Elliott

[11] Patent Number: 5,063,898

[45] Date of Patent: Nov. 12, 1991

[54] PULSED HYDRAULICALLY-ACTUATED FUEL INJECTOR IGNITOR SYSTEM

[76] Inventor: George D. Elliott, 14902 Clovercrest Dr., Huntsville, Ala. 35803

[21] Appl. No.: 580,129

[22] Filed: Sep. 10, 1990

Related U.S. Application Data

[63] Continuation-in-part of Ser. No. 329,519, Mar. 28, 1989, Pat. No. 4,955,340, which is a continuation-in-part of Ser. No. 104,847, Oct. 5, 1987, Pat. No. 4,911,123, which is a continuation-in-part of Ser. No. 904,378, Sep. 8, 1986, Pat. No. 4,700,678.

[51] Int. Cl.[5] ..... F02D 41/04; F02M 47/00

[52] U.S. Cl. ..... 123/297; 123/487; 239/88; 239/92

[58] Field of Search ..... 123/295, 297, 298, 305, 123/472, 476, 478, 488, 487, 557, 446, 447; 239/533.2–533.5, 533.7–533.12, 88, 92

[56] References Cited

U.S. PATENT DOCUMENTS

| | | | |
|---|---|---|---|
| Re. 29,978 | 5/1979 | Leshner et al. | 123/297 |
| 2,484,009 | 10/1949 | Barber | 123/295 |
| 4,404,943 | 9/1983 | Seilly | 123/447 |
| 4,541,385 | 9/1985 | Eheim et al. | 123/447 X |
| 4,760,818 | 8/1988 | Brooks et al. | 123/298 |

*Primary Examiner*—Tony M. Argenbright
*Attorney, Agent, or Firm*—George J. Porter

[57] ABSTRACT

The invention is a pulsed, hydraulically actuated fuel injector ignitor system for an internal combustion engine with combustion chambers and a fuel injector, comprising an outer shell containing a fuel inlet cavity, a fuel supply and scavenging chamber supplied with fuel from the inlet cavity through the rod bore of the injector rod, and a fuel pressure chamber, which is resupplied through check valve from the supply chamber after each injection has taken place. The pressure chamber has a poppet valve responsive to a predetermined fuel pressure in the pressure chamber, resulting from the intrusion of injector piston into the pressure chamber, thereby spraying fuel into the combustion chamber through a hot-throated venturi and igniting the fuel as it passes through venturi. Concentric open-ended cylinders form the control body assembly and are positioned between the base assembly and the fluid manifold head cap and having alternate open-ended cylinders in communication with sliding contact. All cylinders are supported by struts which are firmly attached to a rod. Electro-rheological fluid flows freely through the cylinders of the control body assembly until a high voltage is applied to cylinders, thus solidifying the electro-rheological fluid between cylinders and their adjacent ground potential cylinders. This produces hydraulic pressure in the inlet section of the fluid manifold head cap which forces the assembly and rod downward and piston into the pressure chamber. Removal of the solidifying voltage from cylinders returns the electro-rheological fluid to a liquid state, thereby stopping injection.

8 Claims, 23 Drawing Sheets

DECADE CASCADE COUNTER

NOTE: INITIATION OF SEQUENCING BEGINS WITH LATCHING AND CONTROLLER COUNT DOWN FOR INJECTION ~180° LATER

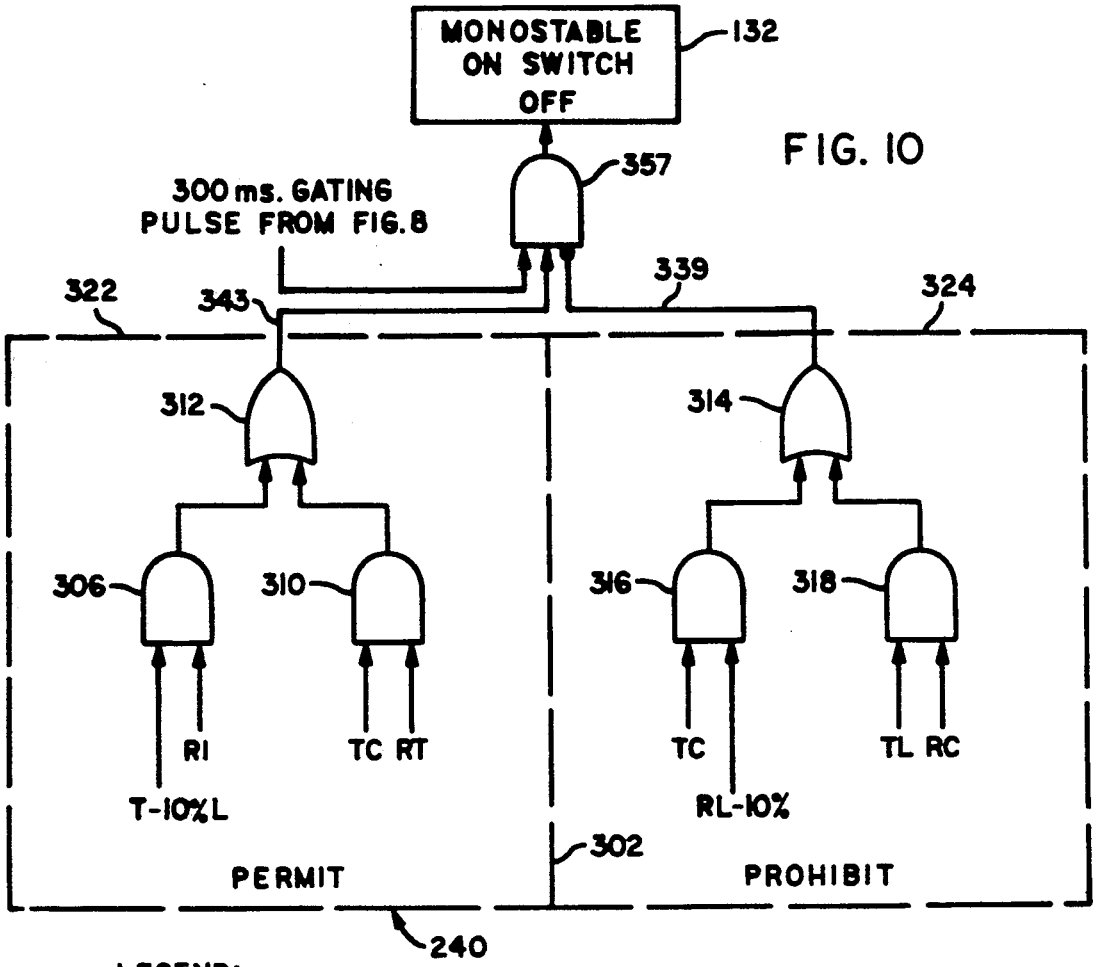
FIG. 10
LEGEND:
| THROTTLE PULSE COUNT | SEQUENCER (ROTOR) PULSE COUNT |
|---|---|
| LOWER ⇒ TL | LOWER ⇒ RL-10% |
| CONSTANT ⇒ TC | CONSTANT ⇒ RC |
| INCREASE ⇒ TI | INCREASE ⇒ RI |
FIG. 10a
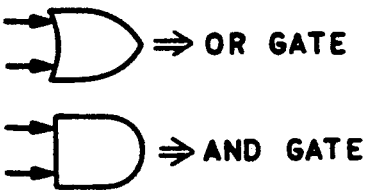
380
| TRUTH TABLE | | |
|---|---|---|
| THROTTLE | ROTOR | DECISION |
| TC | RI | PERMIT |
| TL | RL-10% | PERMIT |
| TC | RL-10% | PROHIBIT |
| TL | RC | PROHIBIT |

SECTION A-A

SECTION B-B

SECTION C-C

SECTION D-D

SECTION E-E

FLUID BLOCK 528 SHOWN IN THE TRIGGERED POSITION

HYDRAULICALLY-DRIVEN FUEL INJECTOR/IGNITOR WITH SPRING RETURN

639

HYDRAULICALLY-DRIVEN FUEL INJECTOR/IGNITOR WITH HYDRAULIC RETURN

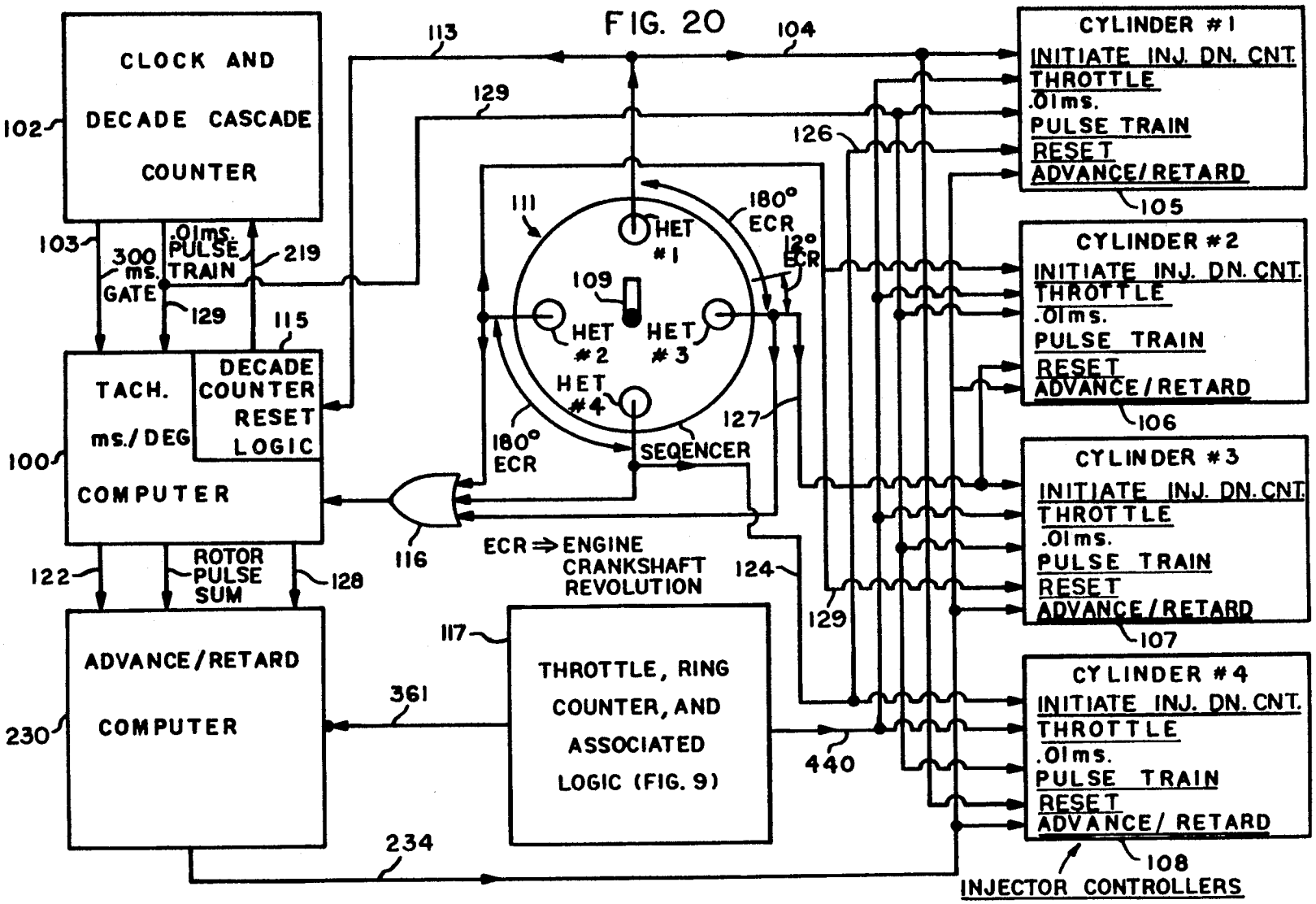
CYLINDER #1
INITIATE INJ. DN. CNT.
THROTTLE
.01ms.
PULSE TRAIN
RESET
ADVANCE/RETARD
105
CYLINDER #2
INITIATE INJ. DN. CNT.
THROTTLE
.01ms.
PULSE TRAIN
RESET
ADVANCE/RETARD
106
CYLINDER #3
INITIATE INJ. DN. CNT.
THROTTLE
.01ms.
PULSE TRAIN
RESET
ADVANCE/RETARD
107
CYLINDER #4
INITIATE INJ. DN. CNT.
THROTTLE
.01ms.
PULSE TRAIN
RESET
ADVANCE/RETARD
108
INJECTOR CONTROLLERS
FIG. 20
104
126
129
440
180° ECR
12° ECR
127
124
HET #1
HET #3
HET #2
HET #4
109
111
SEQENCER
180° ECR
ECR ⇒ ENGINE CRANKSHAFT REVOLUTION
THROTTLE, RING COUNTER, AND ASSOCIATED LOGIC (FIG. 9)
117
113
129
116
361
234
128
CLOCK AND DECADE CASCADE COUNTER
219
.01ms. PULSE TRAIN
115
DECADE COUNTER RESET LOGIC
129
300 ms. GATE
TACH. ms./DEG COMPUTER
ROTOR PULSE SUM
ADVANCE/RETARD COMPUTER
102
103
100
122
230

INJECTOR CONTROL LOGIC

PULSED HYDRAULICALLY-ACTUATED FUEL INJECTOR IGNITOR SYSTEM

CROSS-REFERENCE TO RELATED APPLICATION

This application is a continuation-in-part of U.S. Pat. No. 4,955,340 issued Sept. 11, 1990 (Ser. No. 07/32,519 filed Mar. 28, 1989) which was a continuation-in-Part of U.S. Pat. No. 4,911,123 issued Mar. 27, 1990 (Ser. No. 07/104,847 filed Oct 5, 1987) which was a continuation-in-part of U.S. Pat. No. 4,700,678, issued Oct. 20, 1987 (Ser. No. 06/904,378 filed Sept. 8, 1986), all by George D. Elliott.

TECHNICAL FIELD

This invention relates generally to fuel injection/ignition systems using electronic controls for internal combustion engines and more particularly to a hydraulically-actuated fuel injector having a hot-throated venturi ignition system, thereby allowing the use of a variety of liquid fuels in various types of engines by employing fuel injection.

Because of the complexity of the present specification, it has been divided into sections identified by an index outline in the manner set forth below.

I. GENERAL BACKGROUND OF THE INVENTION
II. BRIEF SUMMARY OF THE INVENTION
III. BRIEF DESCRIPTION OF THE DRAWINGS
IV. BRIEF DESCRIPTION OF PRI0R ART—FIGS. 1 AND 2
V. OVERALL DESCRIPTI0N OF INVENTION—FIG. 3
VI. A GENERAL BUT SOMEWHAT M0RE DETAILED DESCRIPTION OF THE INVENTION—FIGS. 4, 5, AND 6
A. DETAILED DESCRIPTION OF FIG. 4
B. DETAILED DESCRIPTION OF FIG. 5
C. DETAILED DESCRIPTION OF FIG. 6
VII. DETAILED DESCRIPTION OF INVENTION—FIGS. 7, 8, AND 9
A. DETAILED DESCRIPTION OF FIG. 7
B. DETAILED DESCRIPTION OF FIG. 8
C. DETAILED DESCRIPTION OF FIC. 9
VIII. ALTERNATIVE FORM OF THE INVENTION
IX. DISCUSSION OF FIG. 10
X. DETAILED DESCRIPTION OF IMPROVED FUEL INJECTOR/IGNITOR—FIGS. 11, 12, 13, 14, 15, 16 aad 17
A—DETAILED DESCRIPTION OF FIC. 11
B—DETAILED DESCRIpTION OF FIG. 12
C—DETAILED DESCRIPTION OF FIG. 13
D—DETAILED DESCRIPTION OF FIG. 14
E—DETAILED DESCRIPTION OF FIG. 15
F—DETAILED DESCRIPTION OF FIG. 16
G—DETAILED DESCRIPTION OF FIG. 17
XI. DETAILED DE8CRIPTION OF HYDRAULICALLY-DRIVEN FUEL INJECTOR/IGNITOR—FIGS. 18-25
A—DETAILED DESCRIPTION OF FIG. 18
B—DETAILED DESCRIPTION OF FIG. 19
C—DETAILED DESCRIPTION OF FIG. 20
D—DETAILED DESCRIPTION OF FIG. 21
E—DETAILED DESCRIPTION OF FIG. 22
F—DETAILED DESCRIPTION OF FIG. 23

G—DETAILED DESCRIPTION OF FIG. 24
H—DETAILED DESCRIPTION OF FIG. 25

I. GENERAL BACKGROUND OF THE INVENTION

Generally, fuel injection systems, both for diesel engines employing glow plugs and gasoline engines employing spark plugs, are well known in the art. However, no prior art devices are known which combine a variablY controlled injection of fuel directly past the iuel ignition element, initiation (advance or retard) and duration of fuel injecticn is electronicallY computed and controlled in order to determine the output power of the engine.

The known prior art fuel injection systems are substantially stoichiometric in nature in that the fuel is injected in response to a controlled volume of inducted air. Rather, the fuel is injected in a manner to first fill the firing chamber in a substantially uniform mixture of fuel and air, thus allowing subsequent burning of the fuel to be comparatively uncontrolled in that such burning can occur progressively along various different paths within the firing chamber. Thus, these prior art fuel injection systems do not effectively control the burning rate of the fuel but rather permit burning to be initiated by an adiabatic temperature rise which spreads unevenly throughout the firing chamber, thus producing inefficient burning of the fuel and often causing a phenomena commonly known as "knocking" or "pinging" which is presently controlled by fuel additives, many of which have been shown to be environmentally hazardous.

The aforementioned method of mixing fuel and air substantially uniformly in the iiring chamber and in the approximately correct proportion so that all of the fuel and all of the oxygen in the firing chamber combine during burning is known, as a stoichiometric mixture. In other words, each molecule of gasoline theoretically will combine with a sufficient number of oxygen molecules so that a minimum of fuel or oxygen remains after burning of the fuel is completed. As indicated above, this stoichiometric mixture of fuel and air is not only difficult to obtain but also does not produce the controlled burning of the fuel required to provide the greatest and most efficient production of power with the least damage to the engine.

Reference is made to page 171 of a publication entitled "Foundations of College Chemistry," 2nd Edition, by Hein, published in 1970 by Dickinson Publishing Company of Belmont, Calif., which states that, "the student . should solve each problem by . . . being certain that equations are balanced and mathematioaI calculations are accurate. This section of chemistry, based on weight and mole relationships of chemical formulas and equations, is commonly called stoichiometry."

In prior art gasoline engines employing fuel injection, burning does not begin until the spark occurs, by which time the gasoline has become diffused through the firing chamber and is, in effect, an approximate stoichiometric mixture of gasoline and air (oxygen).

In prior art diesel engines using fuel injection, the fuel is first injected and then compressed to the point where it self-ignites. By the time the fuel ignites, it has become an approximate mixture.

It would make a definite advance in the art to provide an almost completely non-stoichiometric fuel injection system in which the fuel is injected, under the control of an electronically controlled timing system, through a constantly heated ignition source or electric discharge. Therefore, it is burned substantially uniformly from the beginning to the end of the fuel injection period without first diffusing generally with the air in the firing chamber. The time duration of the fuel injection and the degree of advance can be determined by the electronically controlled timing sys em of the present invention.

There exists in the prior art at least two types of fuel injector/ignitor devices IID'S), which combine a glow plug (GP) with a compression actuated fuel injector (CAFI), and which, with minor adaptions, are quite compatible with the present invention. Such IID'S are the subject of (1) U.S. Pat. No. 4,700,678, issued Oct. 20, 1987, Ser. No. 904,378 filed Sept. 8, 1986, entitled "Fuel Injector", and (2) U.S. Pat. No. 4,955,340, scheduled to issue Sept. 11, 1990 (Ser. No. 7/329,519 filed Mar. 28, 1989), both by George D. Elliott, the present inventor and both incorporated in their entirety by reference herein.

In this specification a new injector/ignitor device (IID) consisting of a fuel ignition element (FIE) and a CAFI, is shown, described, and claimed and which has structural differences which provide superior performance over any known art and further which can be advantageously utilized in the electronic control circuits of earlier Continuation-in-Part application Ser. No. 07/104,847, (now U.S. Pat. No. 4,911,123, issued Mar. 27, 1990) and also shown, described and claimed by George O. Elliott. Also, in lieu of the IID shown and described in U.S. Pat. No. 4,911,123, another IID is shown in U.S. Pat. No. 4,700,678 dated Oct. 20, 1987 to George D. Elliott. The IID shown and claimed in said later patent comprises a rod with a fuel passing bore therein and a piston formed thereon and enclosed in a piston cylinder chamber. The entire structure, except the bore, is bathed in an electro-rheological fluid mixture which is normally a fluid but which becomes substantially solid when sufficient voltage is applied thereacross to freeze the piston from further movement in its piston cylinder chamber. Freezing of the piston's motion stops the flow of fuel into the combustion chamber (CC) since it is the movement of the piston that forces the fuel into the CC.

II. BRIEF SUMMARY OF THE INVENTION

It is a primary object of this invention to provide such an almost completely non-stoichiometric fuel injection system employing a new and improved fuel injecter in which the fuel is injected through a hot-throated venturI fueI IgnItIon element (FIE) by a pulsed hydraulically-driven fuel injector/Ignitor (PHDFII) so that burning of the fuel occurs substantially uniformly over the entire fuel injection period.

It is another object of the invention to provide such an almost completely non-stoichiometric (oxygen rich) fuel injection system employing a new and improved fuel injector in which the fuel is injected through a fuel ignition element (FIE) by a PHDFII so that burning of the fuel occurs substantially uniformly over the entire fuel injection period, thus insuring more efficient burning of the fuel with resulting greater efficIency and uniformity of generated power per unit of fuel and with less damaging effects to the engine.

It is still another object of the invention to combine a temperature-controlled, hot-throated venturi ignition source (FIE), with a fuel injector (FI) to form an injector/ignitor device (IID), which injects fuel through said FIE and which burns during the entire fuel injection period, and an electronic timing control system responsive to changing EC angular velocity and accelerator position, in which combustion is occurring, to continuously update and control the advance and duration of fuel injection period to their newly computed values.

A further object of the invention is to provide a new, structurally improved injector/ignitor device (IID) which employs a normally fluid electro-rheological (E-R) mixture therein that becomes substantially solid when a sufficient voltage is supplied thereacross and which can be employed in lieu of the(E-R) mixture-containing IID's of FIGS. 1 and 2 and which provides better control of the beginning and duration of the fuel injection than does any other known IID.

A still further object of the invention is to provide a fuel injection system for an internal combustion engine, which burns the fuel in an oxygen-rich environment and at a lower-than-normal temperature, whereby most of the nitrous oxide gas and carbon monoxide are eliminated from the exhaust gases. This allows the elimination from this system of the pollution control devices now required by state and federal laws.

Yet another object of this invention is to provide a fuel injection system for an internal comhustion engine which can use a multiplicity of liquid fuels, even those having low vapor pressure, such as methanol, diesel fuel and kerosene.

In accordance with a preferred embodiment of the invention there is provided, in a fuel injection type internal combustion engine comprising an accelerator, a distributor having a rotatable rotor, and N pulse producing devices each positioned at the outer end of the rotor and each of a type which will produce a rotor pulse each time the rotor passes thereby, a piston and an associated cylinder chamber, with the strokes of each piston bearing a predetermined positional relation with the rotor as the rotor passes the associated pulse producing device, and N fuel ignition elements each extending into the cylinder chamber, a fuel injector device for injecting fuel directly through each fuel ignition element at predeterminable time intervals with respect to the time the rotor passes a given pulse producing device to obtain a substantially non-stoichiometric mixture of fuel and air with the injected fueI being ignited by each fuel ignition element during the entire fuel injection time for controlling the beginning of fuel injection into each of the N cylinder chambers and comprising first logic for computing the number of rotor pulses occuring during a given time interval Z, with the given time intervals Z occurring at periodic intervals.

In accordance with a preferred feature of the invention there is provided, in a fuel injection type internal combustion engine comprising a throttle, N cylinder chambers, a piston associated with each cylinder chamber, a fuel injector (FI) comprising a first outer shell containing a fuel supply connector (FSC) positioned at the top end of the first outer shell, a control body assembly (CBA) positioned within a first outer shell of the fuel injector, a longitudinally movable rod extending substantially from the FSC through the CBA along the entire length of the FI outer shell and having a piston formed thereon, with an internal bore therethrough beginning at the fuel supply inlet connector and which carries fuel from the FSC through the rod and rod outlet ports to the low pressure fuel supply/scavenging chamber at the supporting base. A rod in the fuel injector responsive to hydraulic pressure to cause said rod to move into the fuel pressure chamber (FPC) and by virtue of the pressure of the rod moving into the FPC fuel is forced from the injector nozzle and into the combustIon chamber (CC). A plurality of concentric open ended cylinders (OEC'S) are located around the rod thus forming the CBA and OEC suPPort struts secured at one end thereof to the rod and at the opposite end support struts containing insulative spacers positioning the OEC'S. E-R fluid fills that portion of the FI between the FSC and the base and becomes solidified between paired OEC'S when a predetermined voltage is supplied to selected OEC'S.

Logic means is provided (FIGS. 18 and 25) to respond to the throttle position to remove the solidifying voltage to said E-R fluid in said FI causing cessation of fuel injection as set forth generally below.

The CBA formed by the OEC'S is responsive to hydraulic pressure exerted by a positive displacement pump when the E-R fluid is in a solidified state thus enabling the rod and its piston to begin and to continue moving into the FPC, thereby forcing fuel into the combustion chamber. It is further responsive to the liquid state of the E-R fluid between the OEC'S resulting from throttle position to stop movement of the rod into the FPC and thereby stop the fuel from being forced into the combustion chamber.

It should be understood that this specification, claims and drawings are directed toward an unrestricted air intake and an unrestricted airflow into the engine. Throughout the specification, claims and drawings, the terms "throttle" and "accelerator" have been used interchangeably and refer only to the control of the fuel injected into the engine. The controller covered by this application distinguishes over the known prior art devices in that this device combines the following features:

1. Either restricted (staged) or unrestricted airflow into the engine.

2. Control of the power output of the engine by controlling both the amount and the time duration of the fuel injected into the engine. The fuel is burned as it is injected into the engine.

3. The conventional air throttle is not used in this embodiment. No throttle is required in the device described herein although a throttle could be employed if a specific fuel injector would operate more efficiently with a staged restricted airflow.

BRIEF DESCRIPTION OF THE DRAWINCS

The above-mentioned and other objects and features of the invention will be more fully understood from the following detailed description thereof when read in conjunction with the drawings in which.

Figure 3:
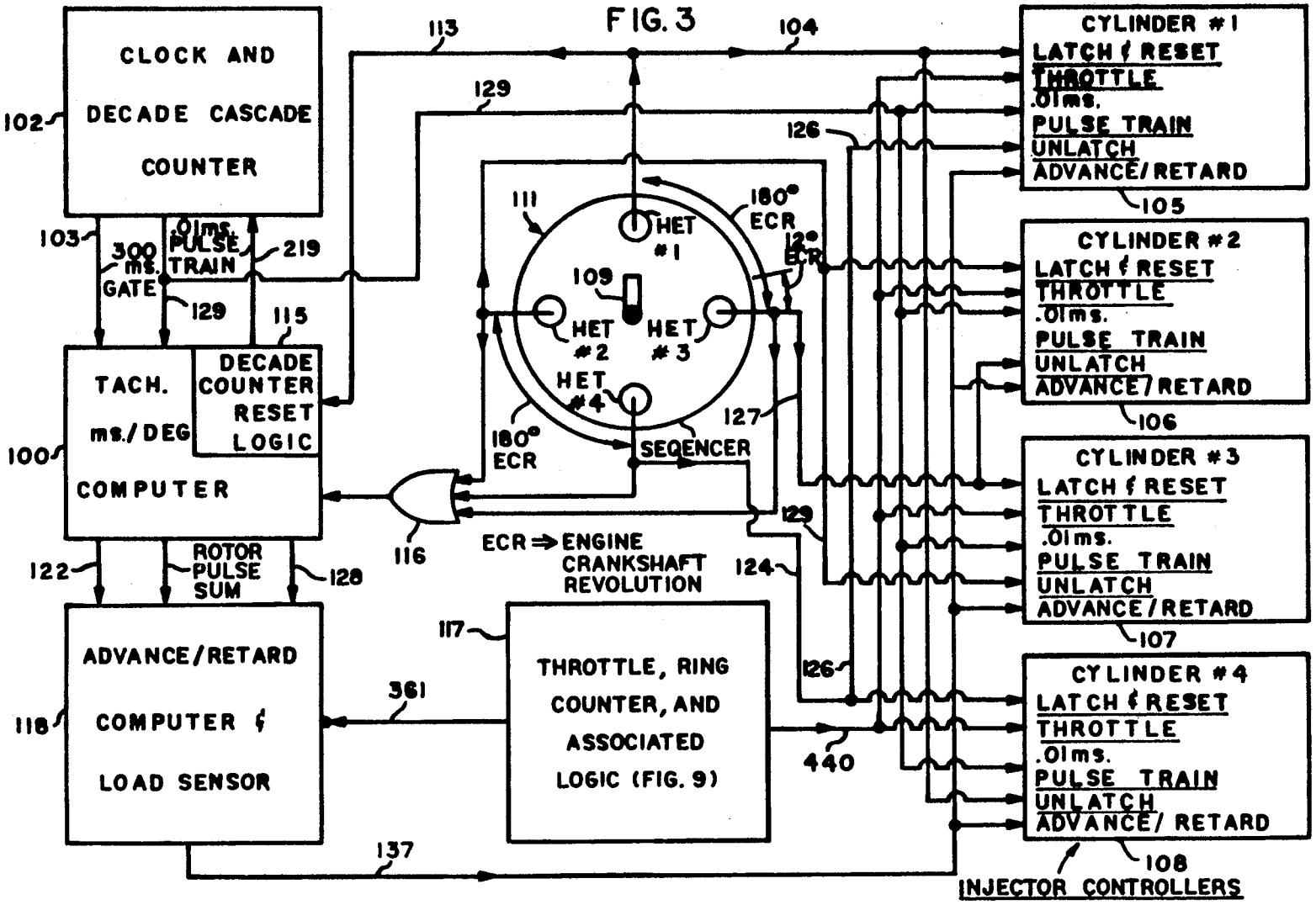
FIG. 3 shows a general, overall block diagram of the iavention.
Figure 3A:
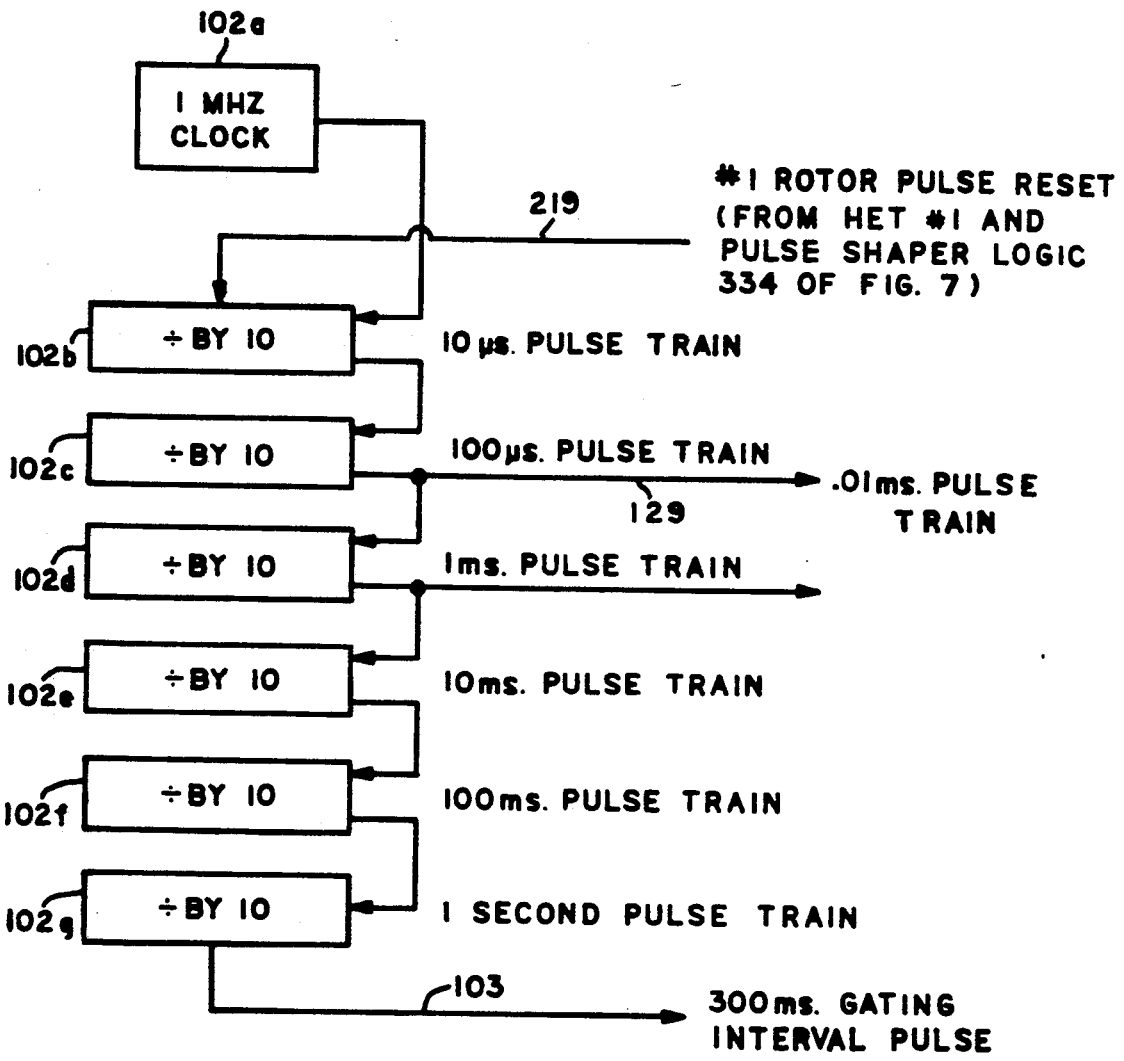
Figure 4:
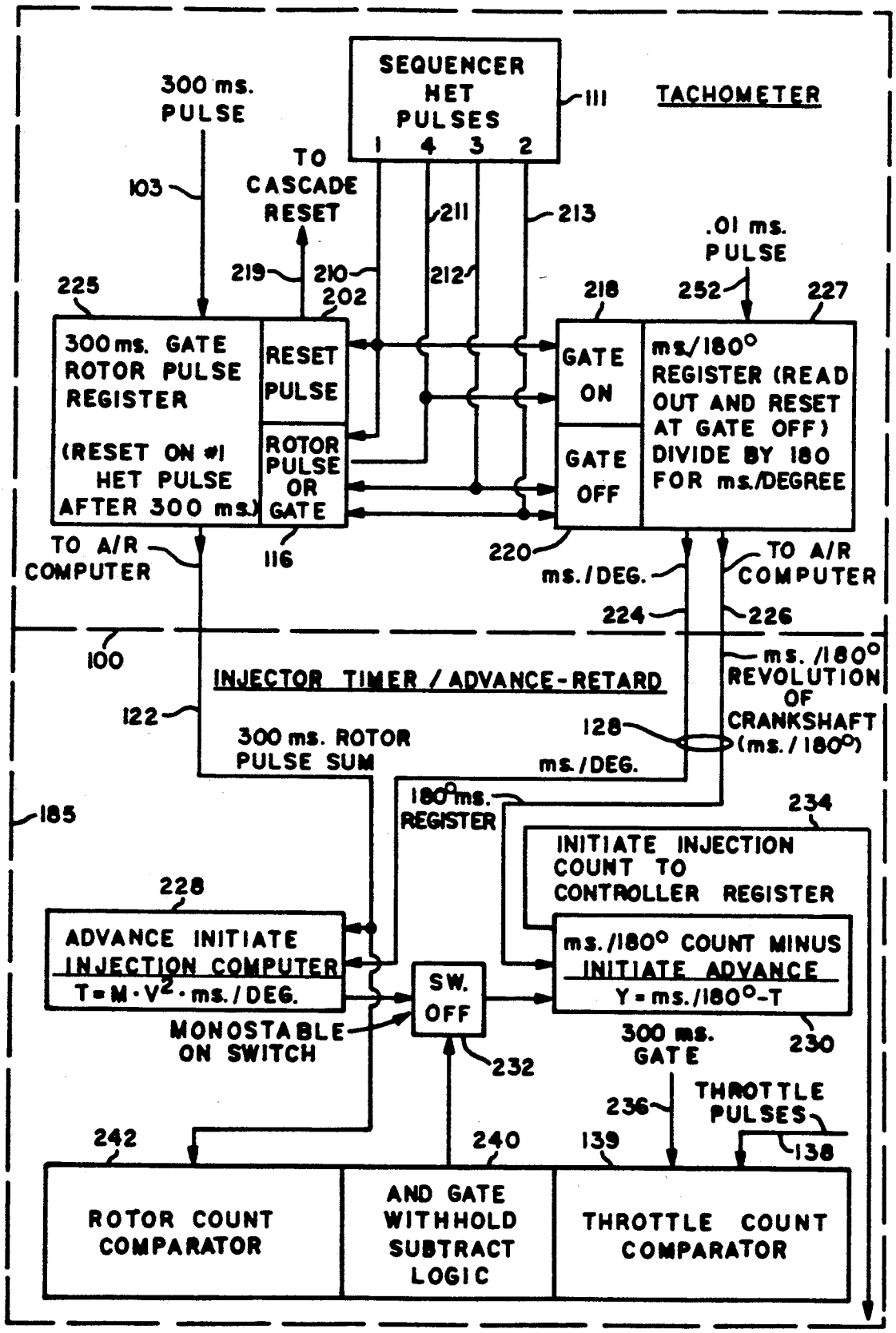
Figure 5:
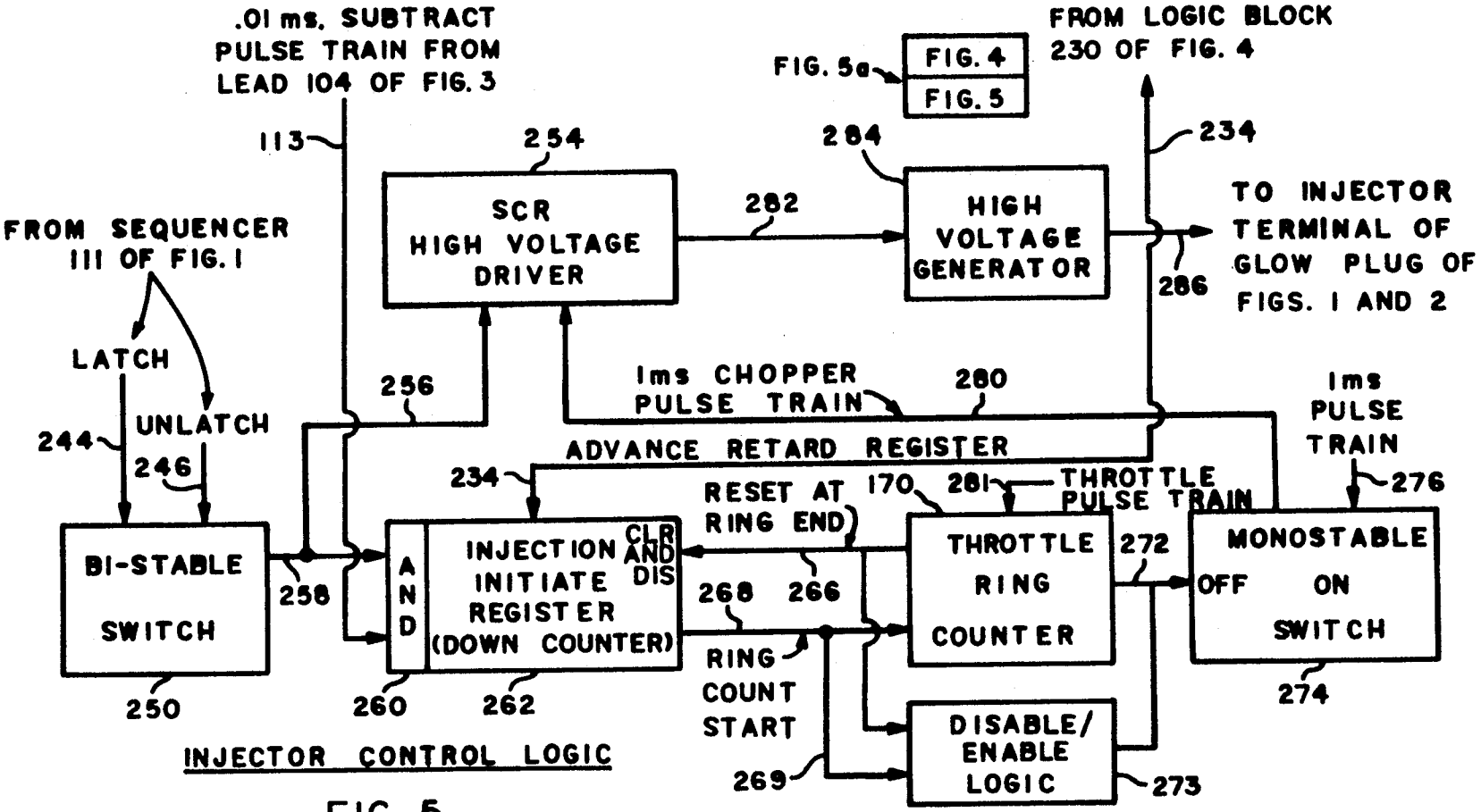
Figure 6:
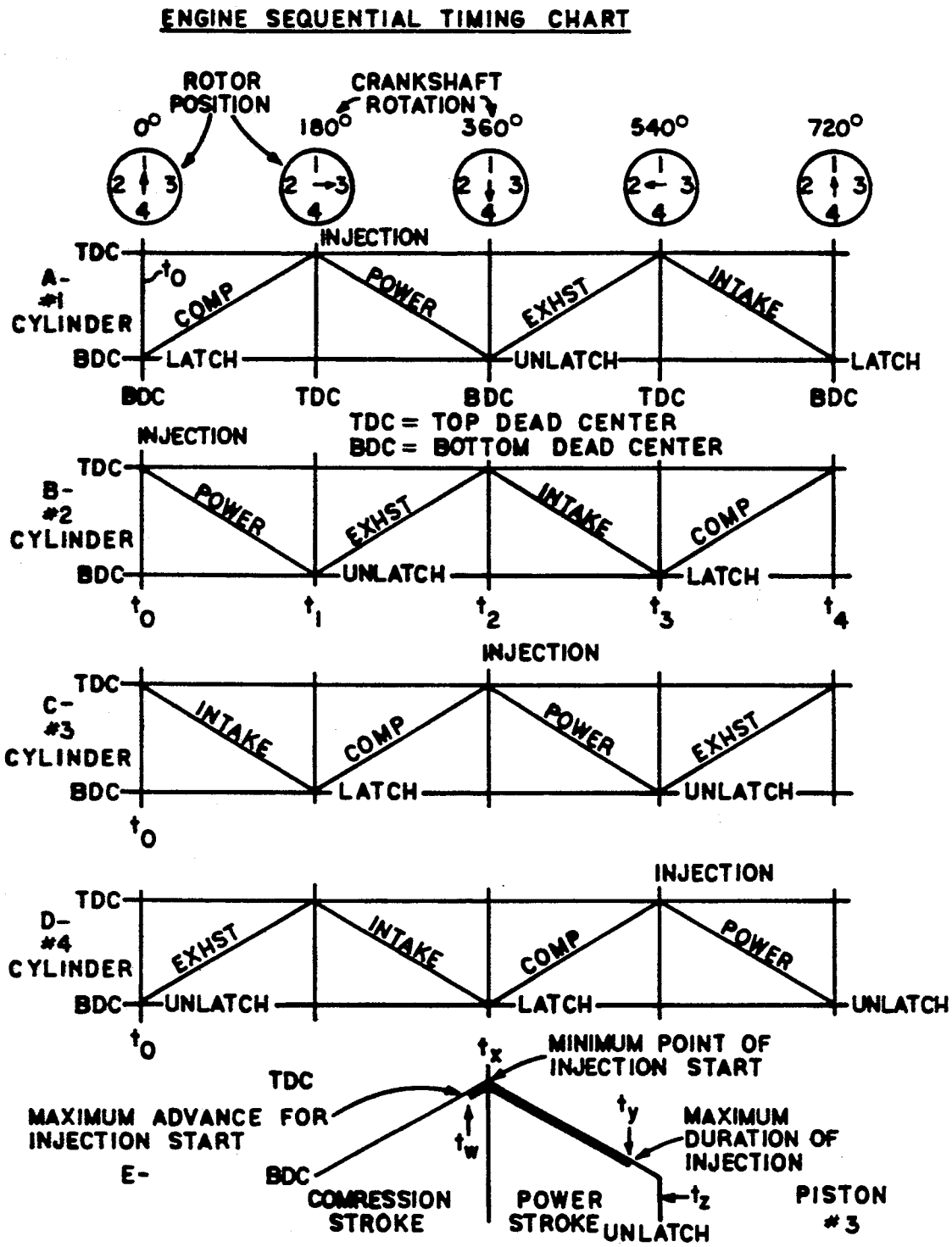
Figure 7:
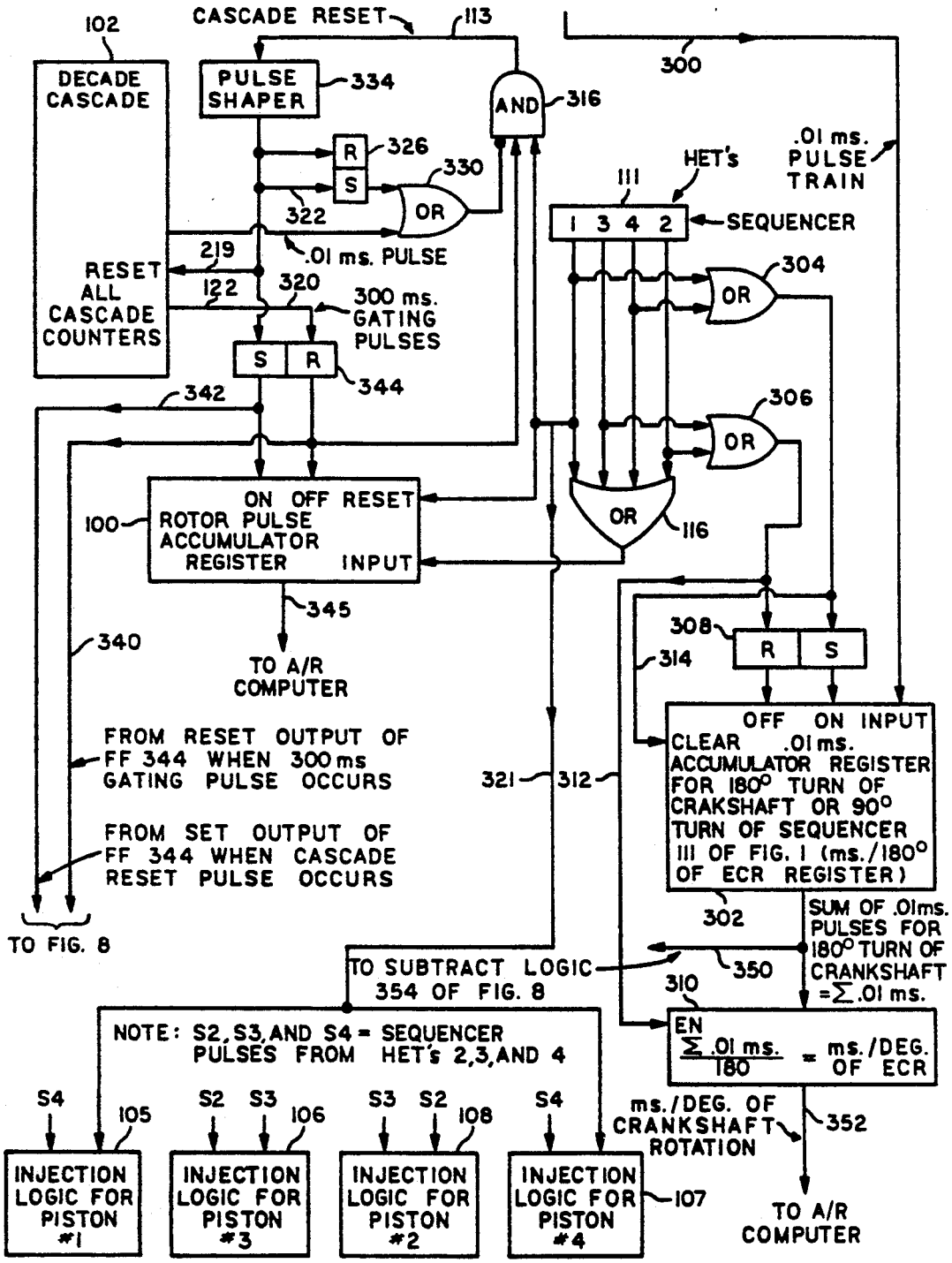
Figure 8:
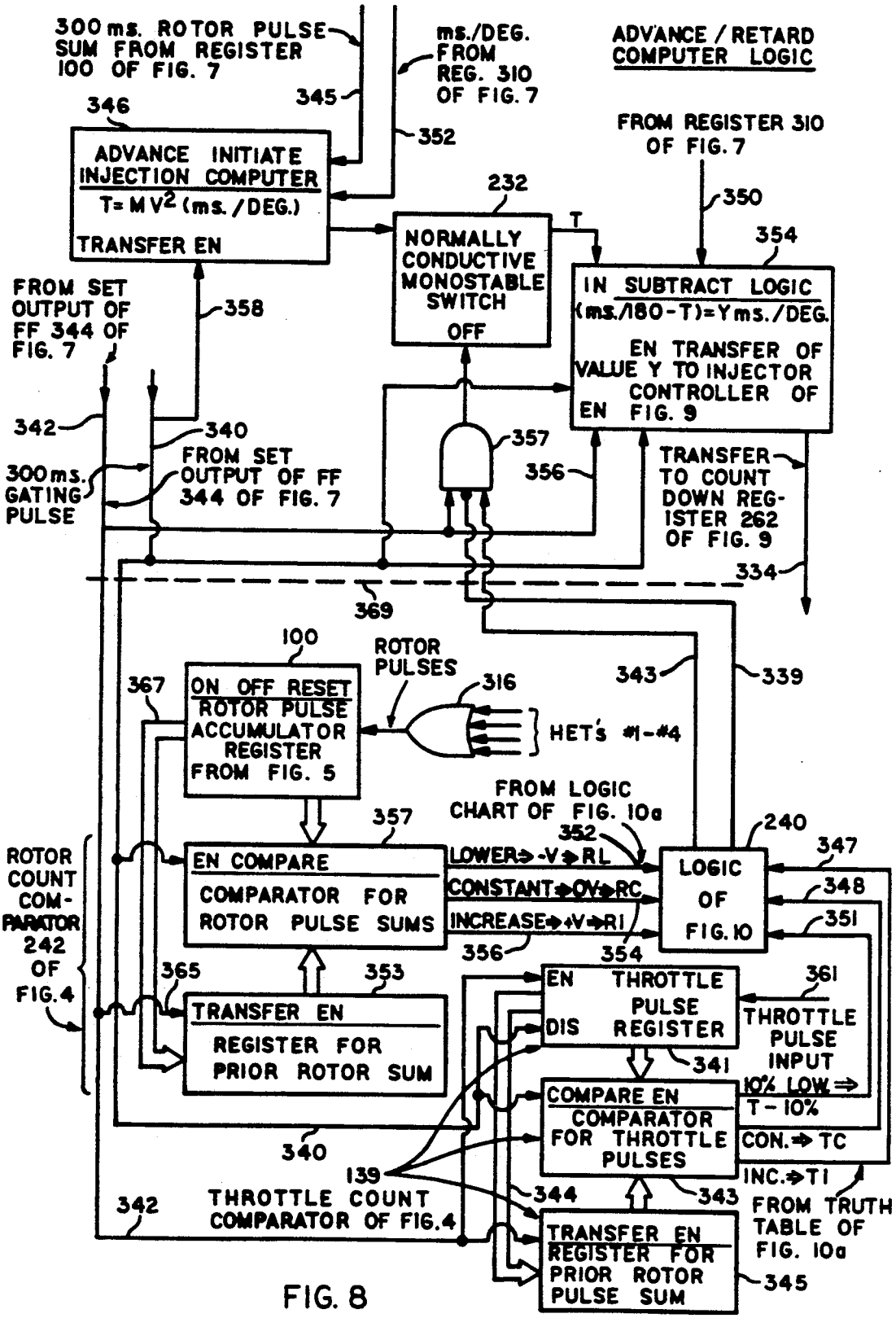
Figure 9:
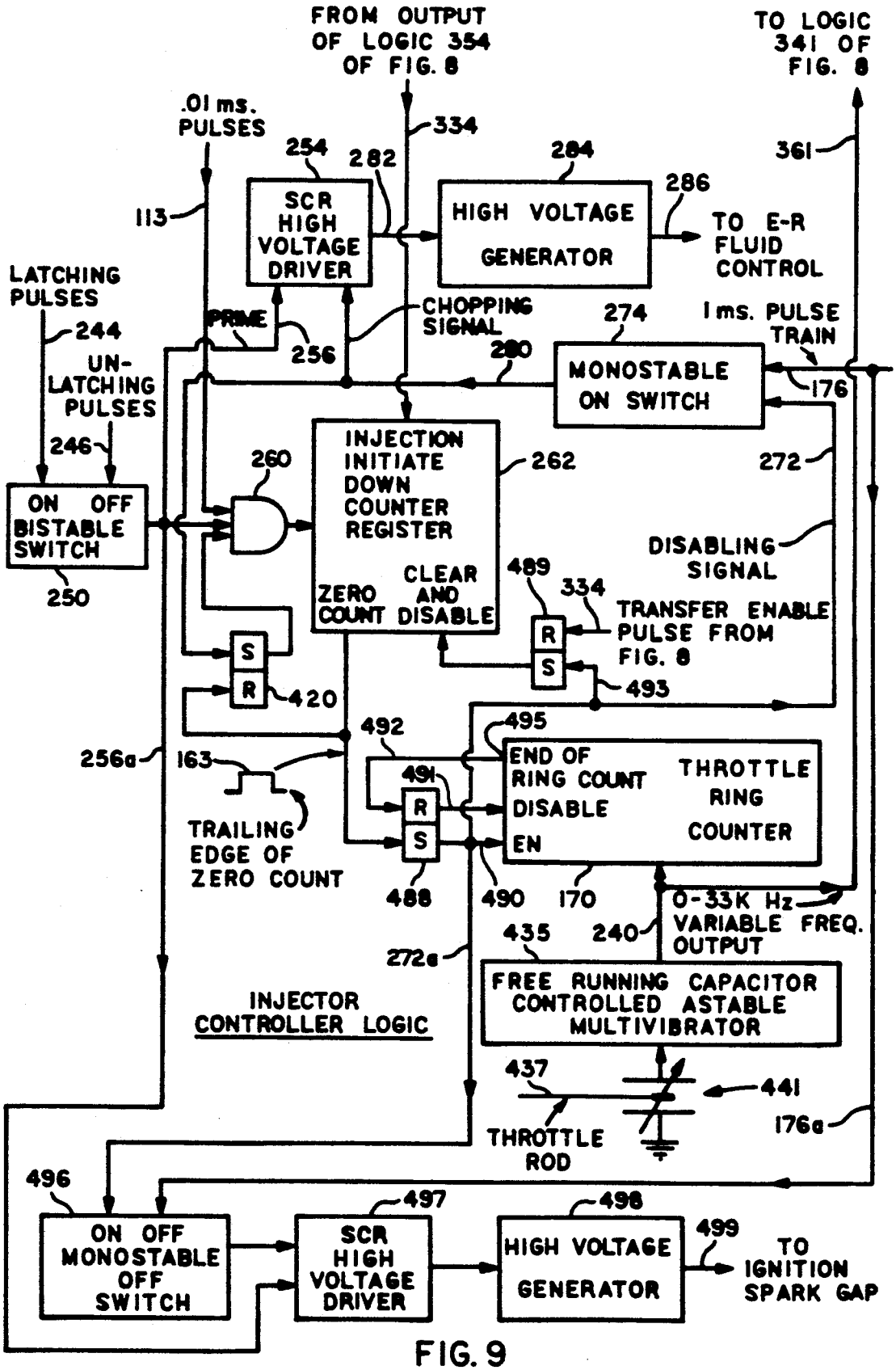
Figure 7A:
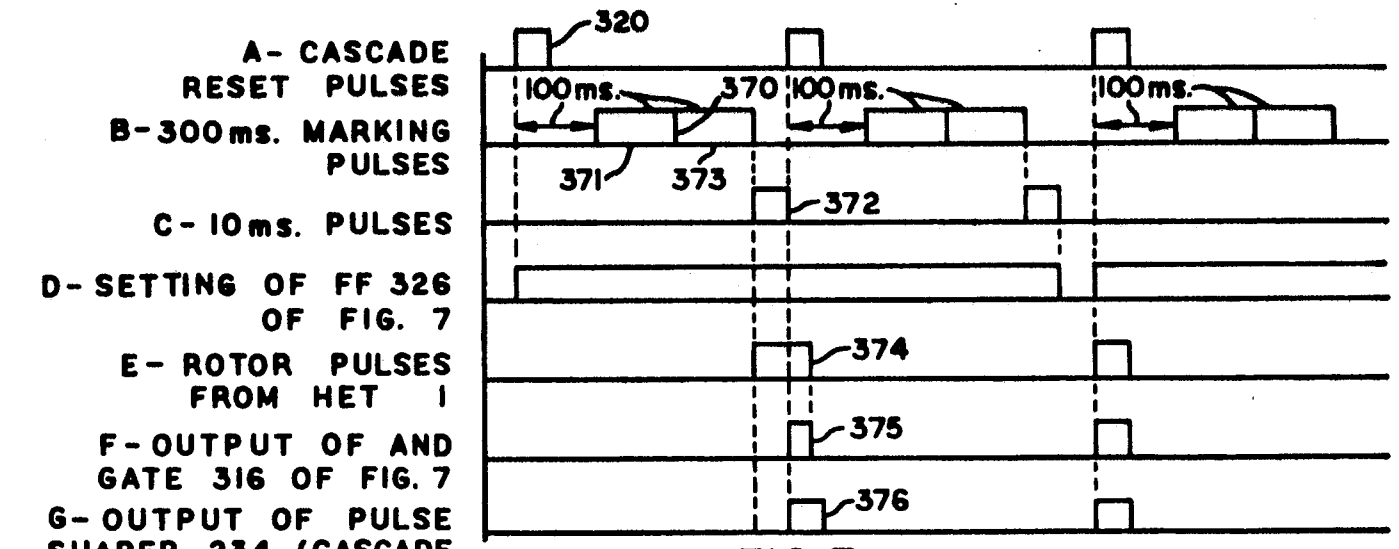
Figure 9A:
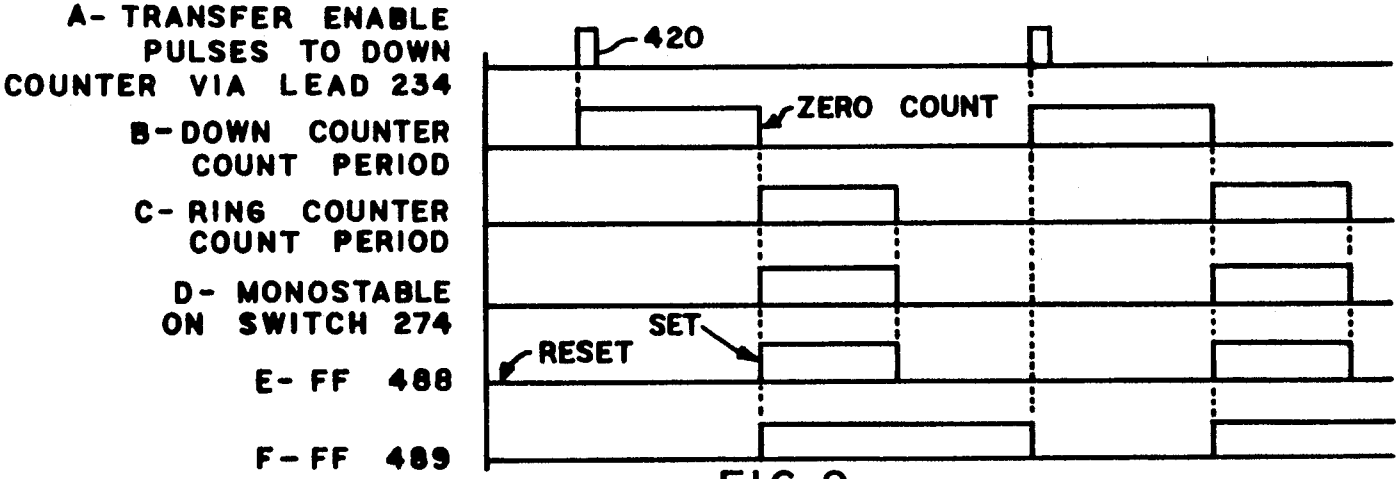
Figure 11:
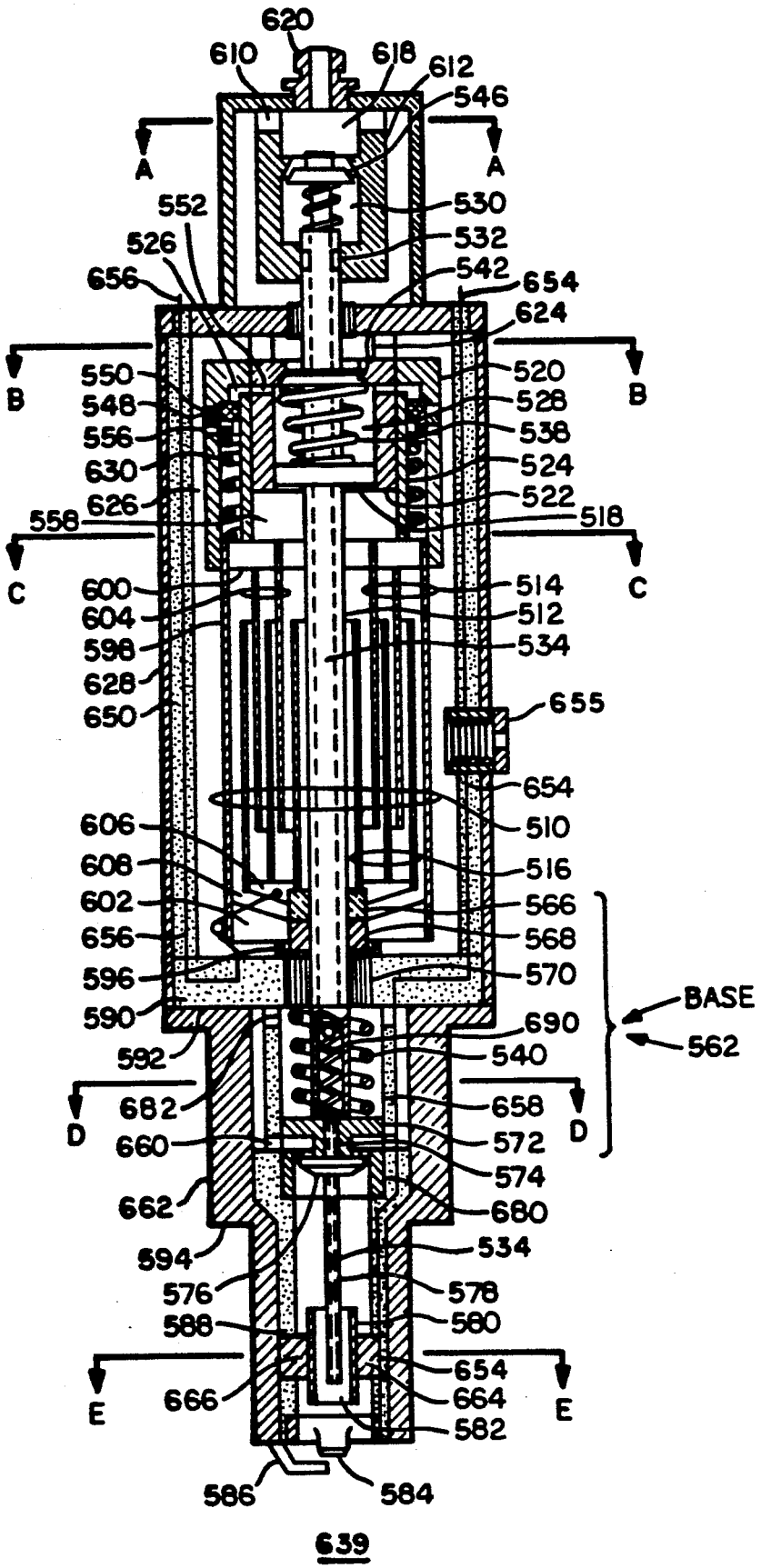
Figure 12:
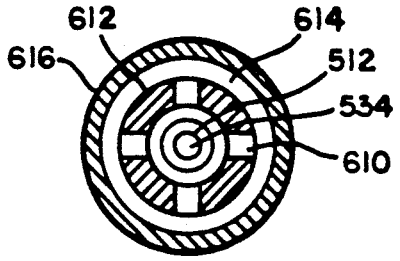
Figure 13:
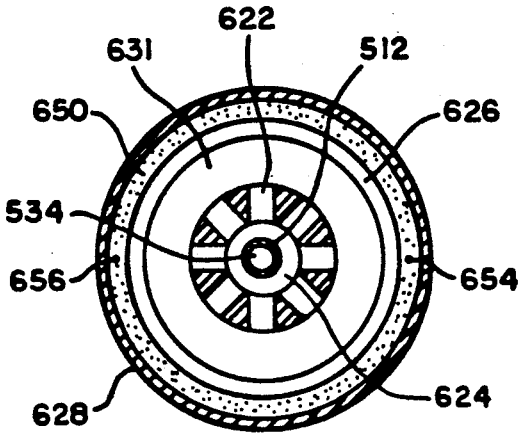
Figure 14:
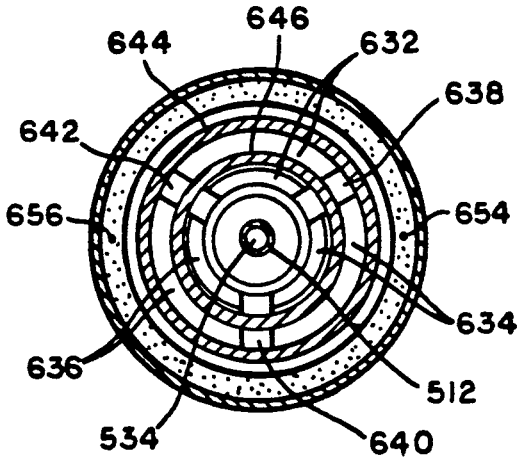
Figure 15:
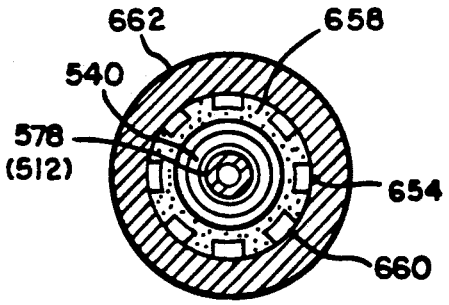
Figure 16:
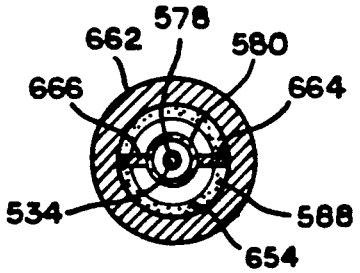
Figure 17:
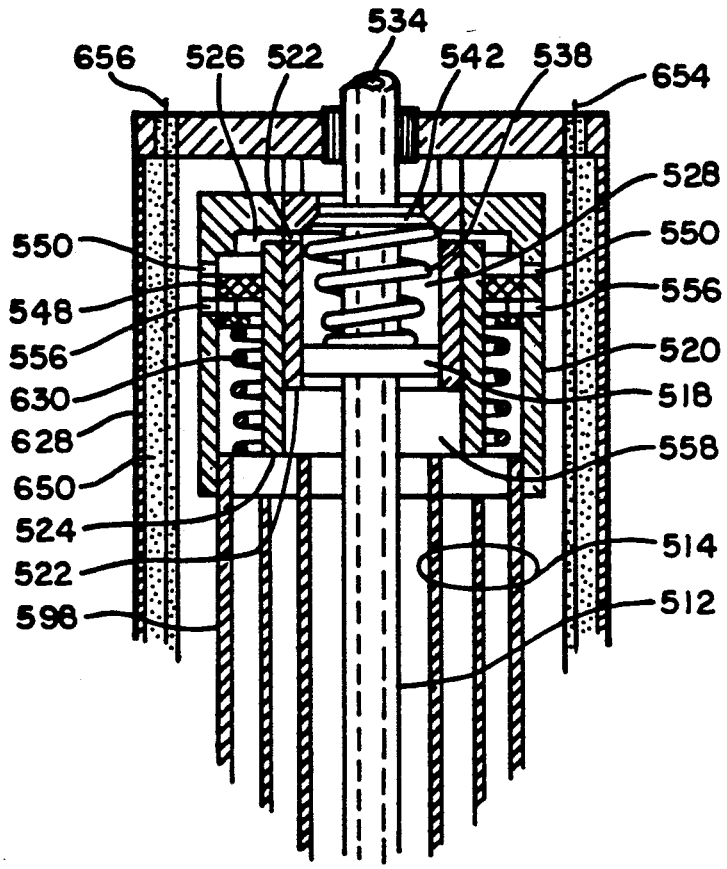

FIG. 3*a* is a more detailed showing of the decade counter of FIG. 3;

FIGS. 4 and 5, considered together in the placement manner shown in FIG. 5*a*, show a somewhat more detailed overall diagram of the invention but with each major logic section showing the sub-logic sections contained therein;

FIGS. 6(A–E) show a timing diagram of the time relation of the movement of the pistons and the time of latching and unlatching of the IC associated with each piston; FIG. 7 is a detailed logic diagram of the tachometer logic;

FIG. 7*a* is a timing diagram of the operation of the tachometer logic of FIG. 7;

FIG. 8 is a detailed logic diagram of the injector timer for the advance/retard logic;

FIG. 9 shows a detailed logic diagram of the injection controller of the invention;

FIG. 9*a* is a timing diagram of the injection controller;

FIG. 10 shows detailed logic of a portion 240 of FIG. 8 which interprets throttle and rotor pulse rates to output a signal determining whether the time of fuel ignition should be advanced or retarded;

FIG. 10*a* is a truth table relating to the logic 240 of FIG. 8;

FIG. 11 is a first cross-sectional view of the modified fuel injector of the present invention taken along its longitudinal axis;

FIG. 12 is a second cross-sectional view of the complete structure of FIG. 11 taken along the plane A—A of FIG. 11;

FIG. 13 is third-cross sectional view of the complete structure of FIG. 11 taken along the plane B—B of FIG. 11;

FIG. 14 is a fourth cross-sectional view of the complete structure of FIG. 11 taken along the plane C—C of FIG. 11;

FIG. 15 is a fifth cross-sectional view of the complete structure of FIG. 11 taken along the plane D—D of FIG. 11;

FIG. 16 is a sixth cross-sectional view of the complete structure of FIG. 11 taken along the plane E—E of FIG. 11; and FIG. 17 taken along the plane E-E of FIG. 11; and FIG. 17 is an enlarged view of the contrcl body assembly (CBA) of the improved FI.

Figure 18:
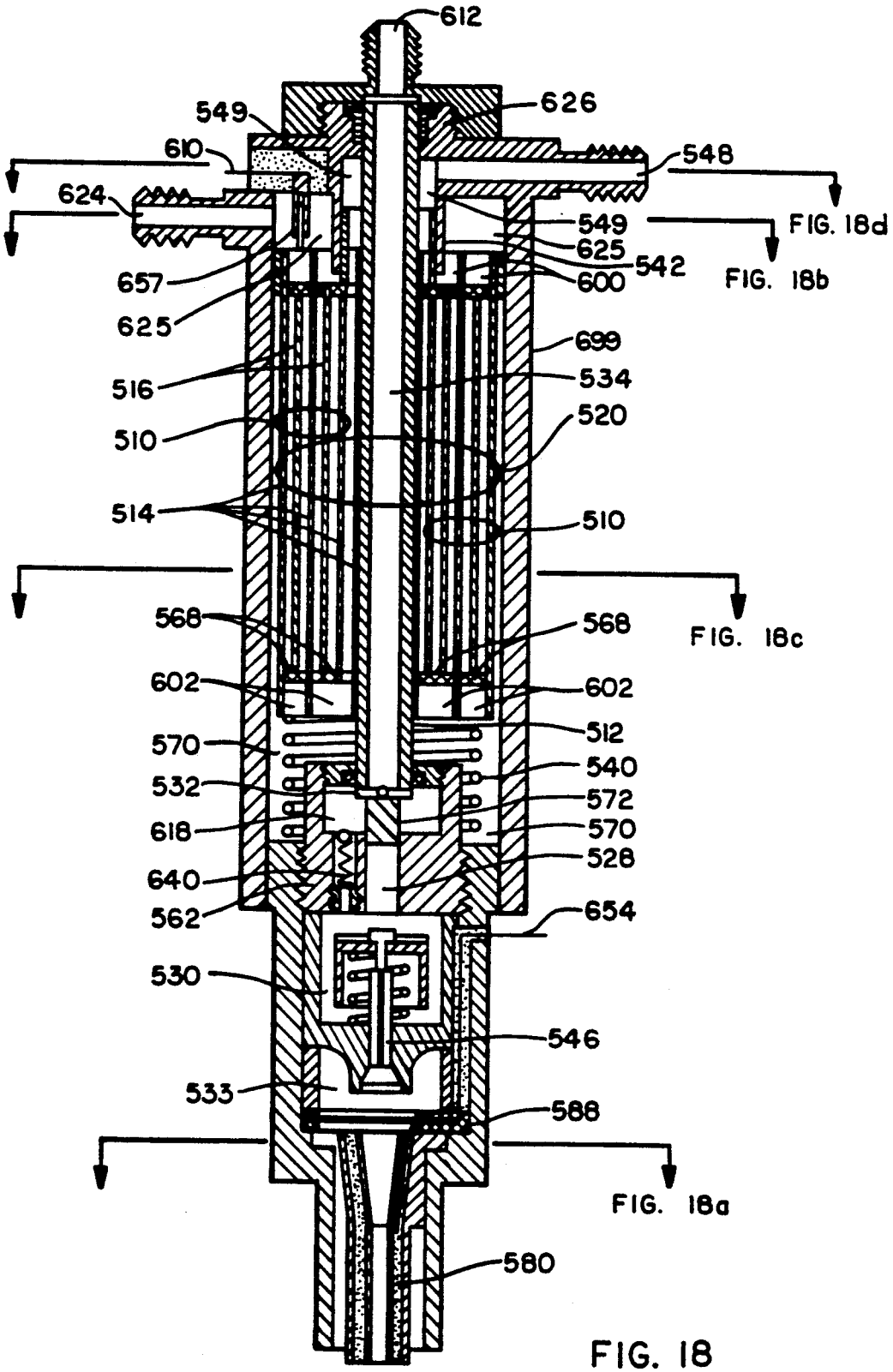

FIG. 18 is a cross-sectional view of a hydraulically-driven fuel injector/ignitor with spring return, taken along its longitudinal axis.

Figure 18A:
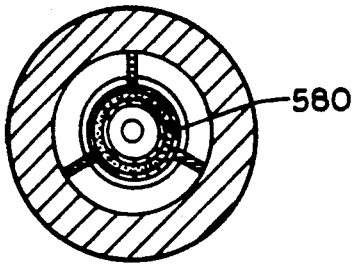

FIG. 18*a* is a sectional view taken along the plane AA of FIG. 18.

Figure 18B:
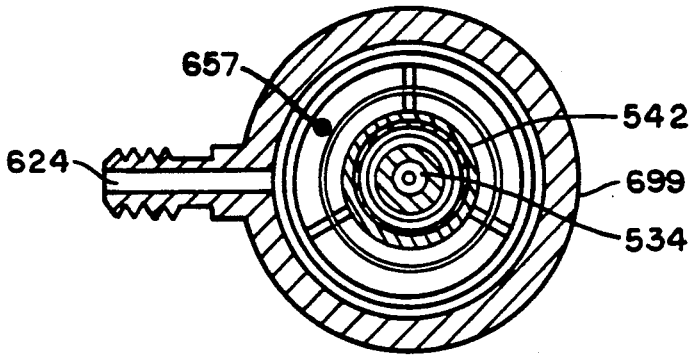

FIG. 18*b* is a sectional view taken along the plane BB of FIG. 18.

Figure 18C:
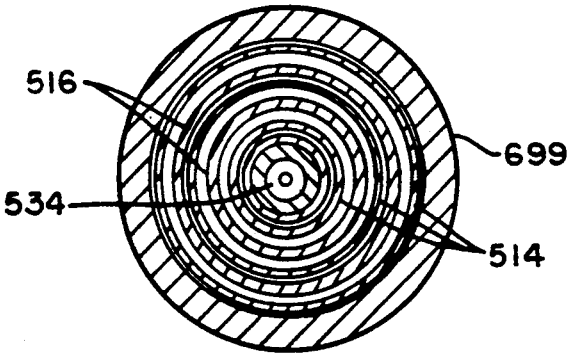

FIG. 18*c* is a sectional view taken along the plane CC of FIG. 18.

Figure 18D:
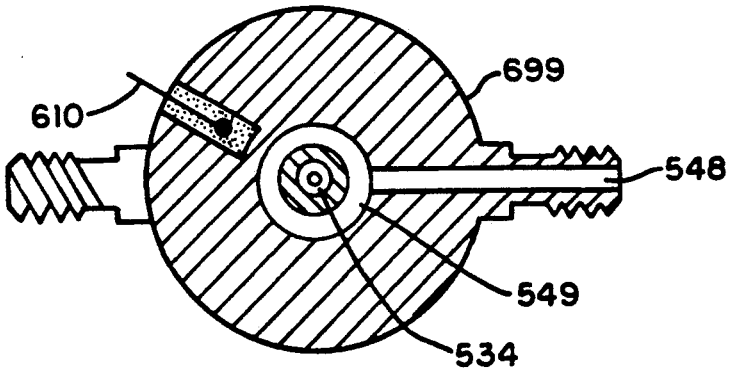

FIG. 18*d* is a sectional view taken along the plane DD of FIG. 18.

Figure 19:
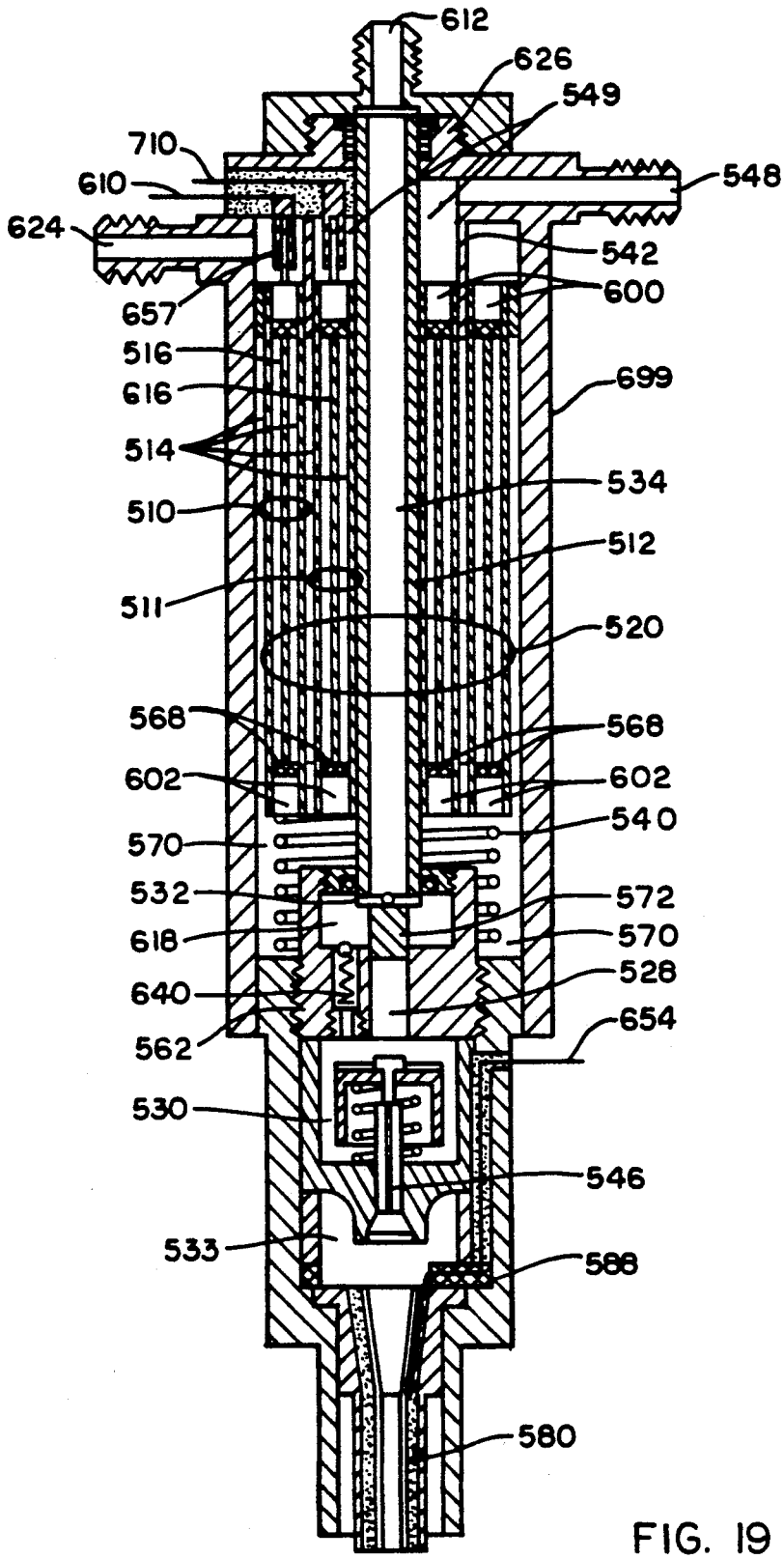

FIG. 19 is a cross-sectional view of the hydraulically-driven fuel injector/ignitor with hydraulic return, taken along its longitudinal axis.

FIG. 20 is a block diagram of the controller for the hydraulically-oPerated injector/ignitor.

Figure 21:
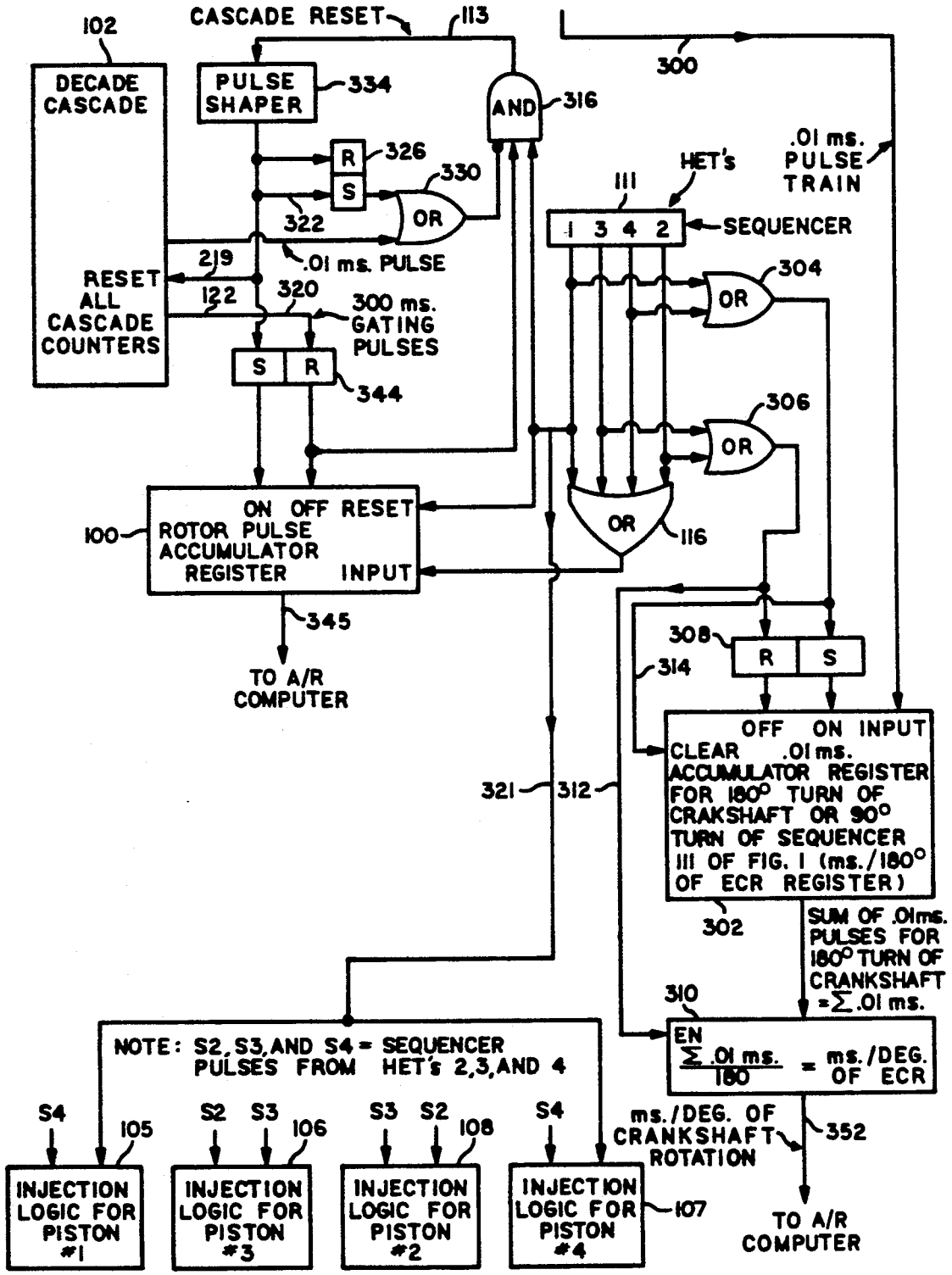

FIG. 21 is an overall block diagram of the controller showing the injection logic for the pistons.

Figure 22:
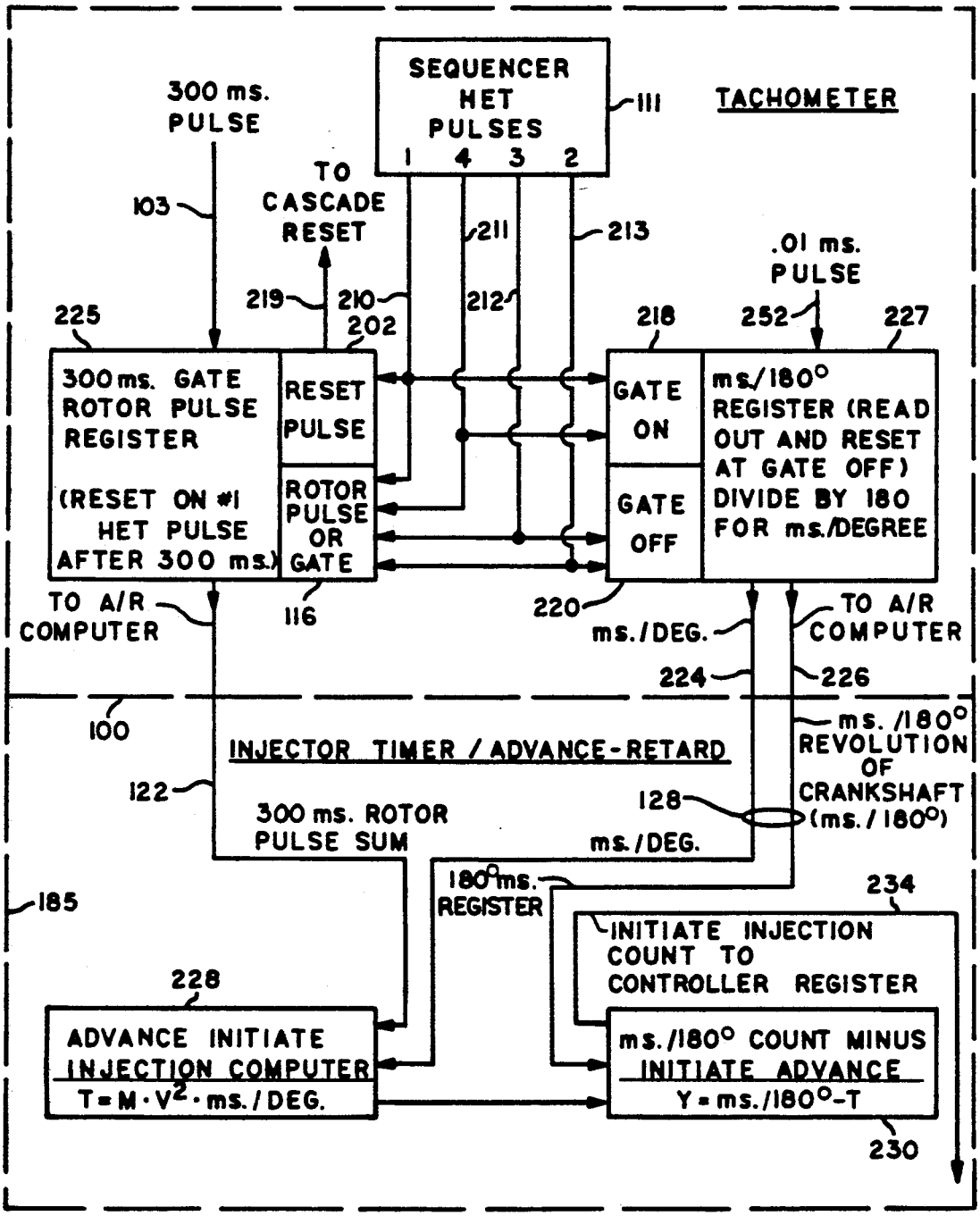

FIG. 22 is a block diagram showing the injection initiate and update computer for the hydraulically operated embodiment of the invention.

Figure 23:
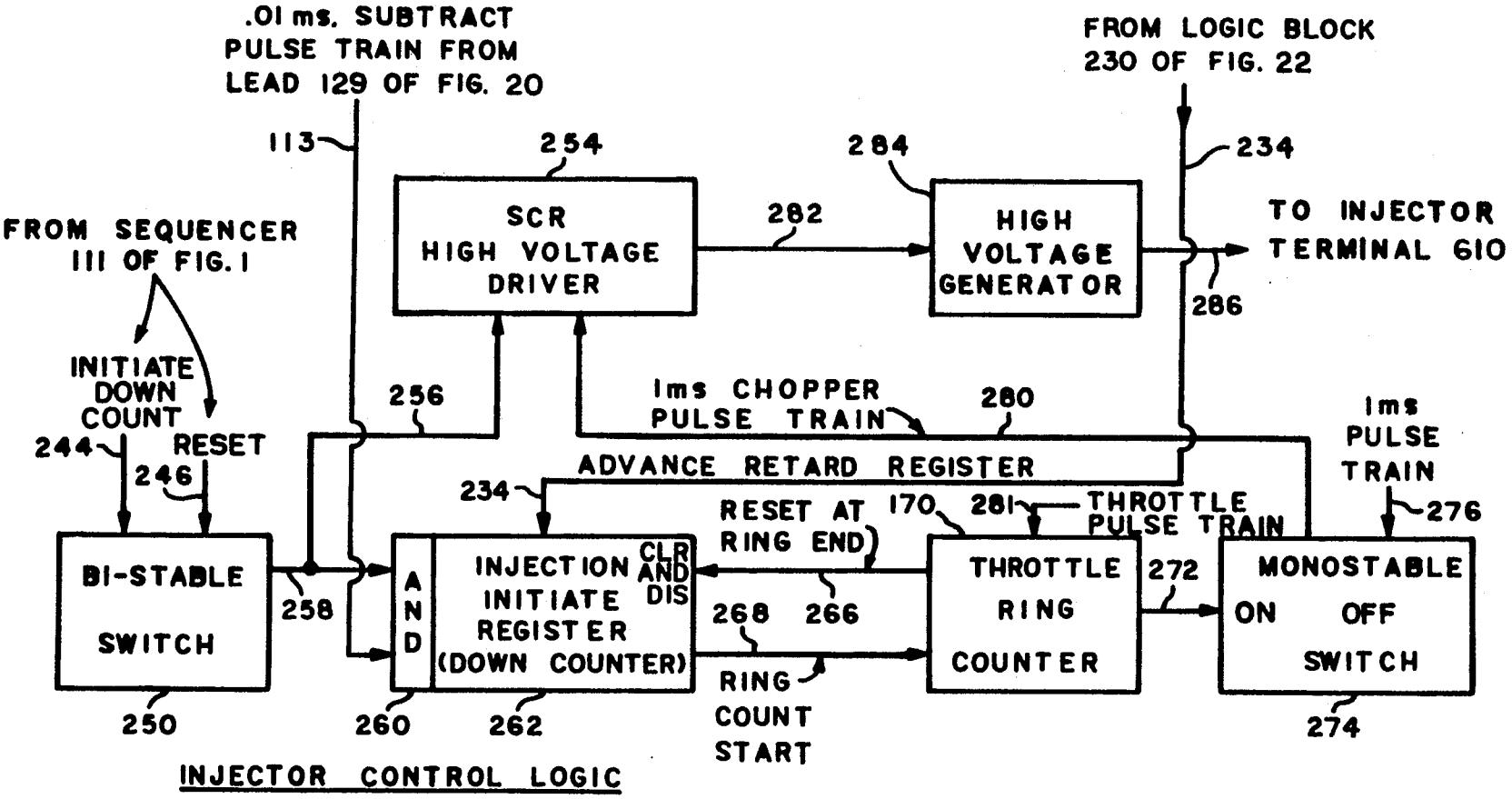

FIG. 23 is a block diagram showing the injection control logic for the hydraulically-operated embodiment of the invention.

Figure 24:
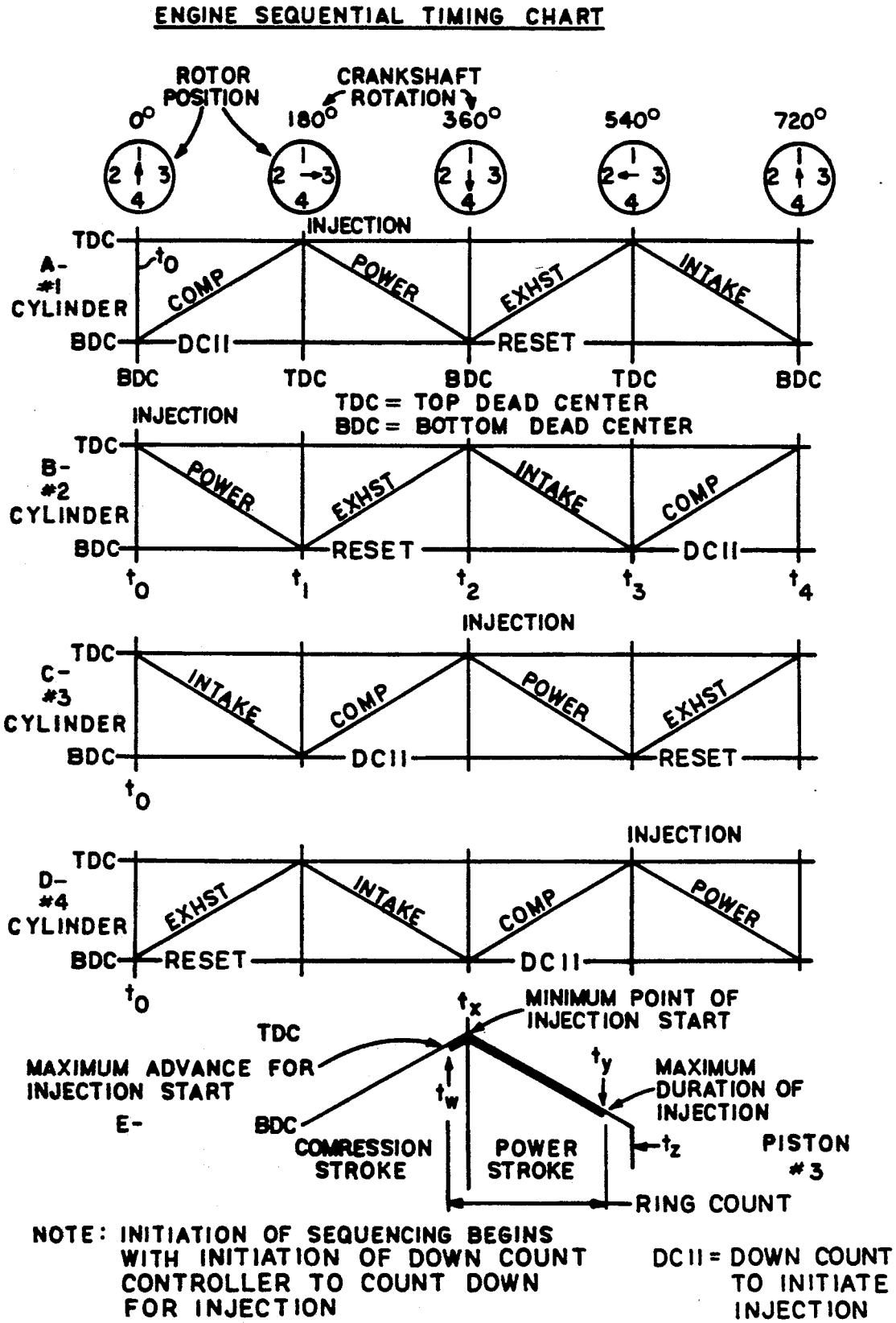

FIGS. 24(A–E) are a timing diagram showing the engine sequential timing chart for the hydraulically-operated embodiment of the invention.

Figure 25:
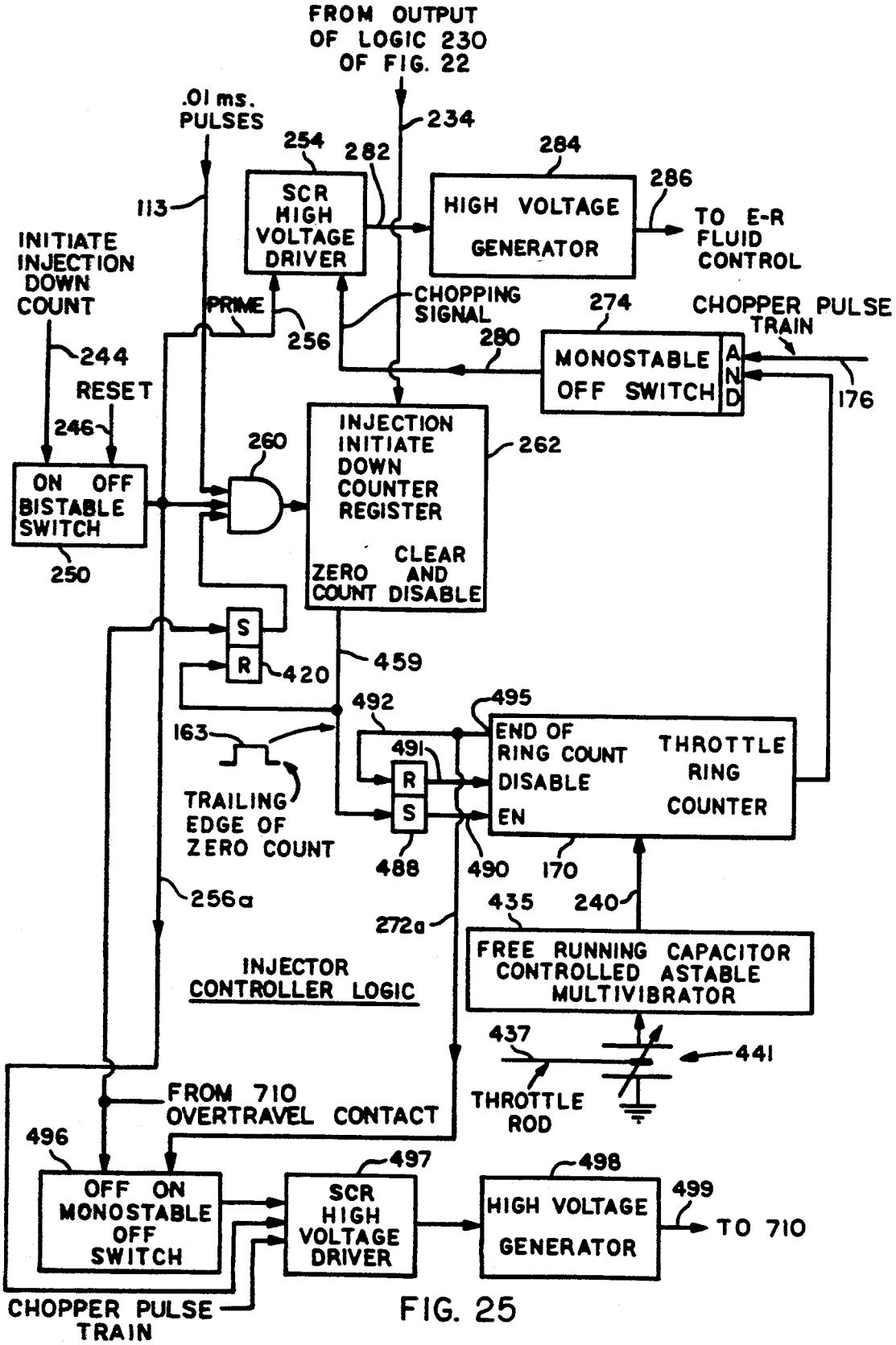

FIG. 25 is a block diagram of the detailed logic for the hydraulically operated fuel injector/ignitor system.

IV. BRIEF DESCRIPTION OF PRIOR ART—FIGS. 1 AND 2

Figure 1:
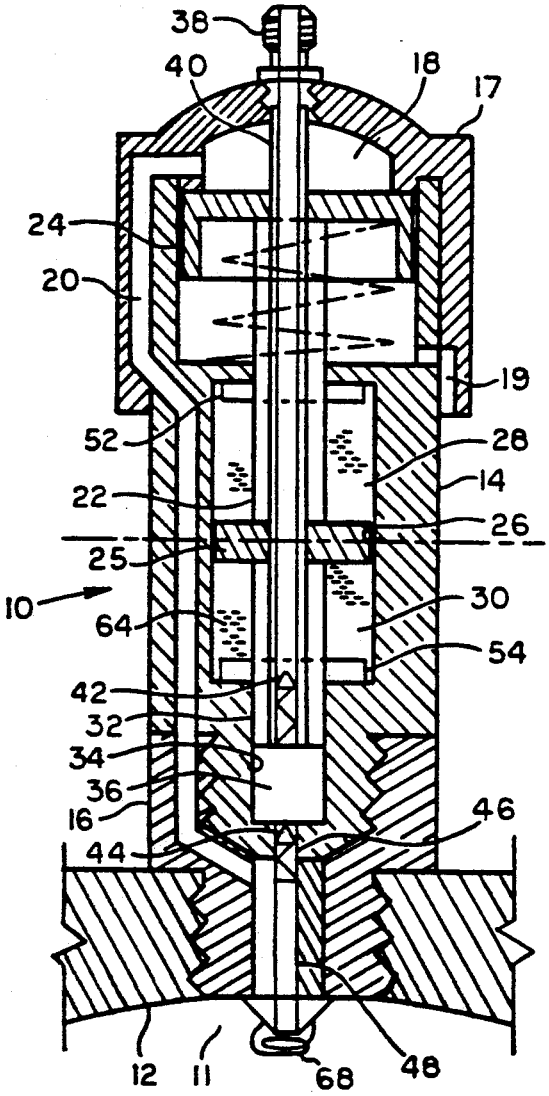
FIGS. 1 and 2 show a prior art IID of the CAFI type fuel injector device.
Figure 2:
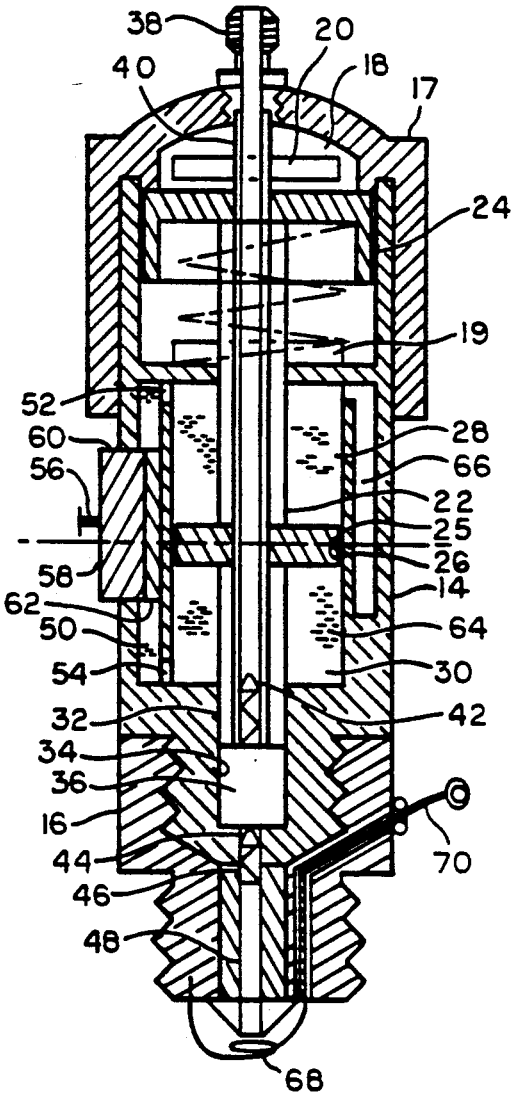

Referring first to FIGS. 1 and 2 there is shown a prior art injector/ignitor device (IID), referred to herein before as the subject matter of U.S. Pat. No. 4,700,678, which can be employed, if desired, in lieu of other suitable IID's, with the present invention to provide a complete electronically controlled fuel injection system. Referring now to FIG. 1 of this prior art injector 10 is adapted for threaded engagement into a cylinder head 12 of an internal ccmbustion engine. The injector comprises a housing assembly which is made up of three basic housings, the details of which will be described hereinafter.

An injector housing 14 is threadedly attached to a nozzle housing 16 at its lower end. The nozzle housing in turn is threadedly attached to the cylinder head 12. At the upper end of injector housing 14 is attached a compression chamber housing 17 which, in combination with the injector housing 14, forms a compression chamber 18. Compression chamber 18 communicates with a combustion chamber 11 of cylinder head 12 through a compression passage 20 which is formed by the compression chamber housing 17, the injector housing 14, and the nozzle housing 16. An injector rod 22 is slidably mounted within injector housing 14. At the upper end of injector rod 22 is attached a primary piston 24 which is located within the compression chamber 18. The area below primary piston 24 is vented to the atmosphere by a passage 19. A metering spool 25 is rigidly attached to the mid portion of the injector rod 22 and is slidably mounted in a metering chamber 26 which is formed in the intermediate portion of the injector housing 14. The metering spool 25 effectively separates the metering chamber 26 into an upper chamber 28 and a lower chamber 30. At the lower end of injector rod 22 is formed a secondary piston 32 which slidably engages a cylinder wall 34 which forms a fuel supply chamber 36 within the lower portion of the injector housing 14. At the upper portion of the injector a fuel inlet fitting 38 is threadedly attached to the combustion chamber housing 17 and is also rigidly attached to a fuel supply tube 40 which passes through and slidably engages the center portion of injector rod 22. A spring biased check valve 42 is mounted within the lower portion of the fuel supply tube 40 to prevent reverse flow of fluid in the supply tube. An additional check valve 44 is provided in a lower passage 46 which communicates with a passage 48 formed in the nozzle housing. Passage 48 thus communicates with compression passage 20 as well as with the fuel supply (lower) passage 46. The valve 44 serves to prevent combustion pressures from entering fuel supply chamber 36 but allows pressurized fuel to pass enroute to the combustion chamber 11.

Alternatively the fuel may also be fed directly into the fuel supply chamber 36 thorough a fuel supply passage 47 formed in the lower side portion of injector housing 14.

Referring now to FIG. 2, it will be noted that a fluid bypass chamber 50 is formed in the side portion of injector housing 14 and provides communication via outlets 52 and 54 between the upper portion 28 and the lower portion 30 of metering chamber 26. An electrical connection 56 is mounted to an insulated housing 58. The connector 56 is conductively connected to a series of electrodes 60 which are illustrated in FIG. 2. As will also be noted in FIG. 2, a series of electrodes 62 are conductively mounted to the inner portion of injector housing 14 and are located within the bypass chamber 50. Thus it will be seen that upon application of a voltage to electrical connector 56, an electrical potential will exist between the positive electrodes 60 and the negative electrodes 62, which are grounded through the cylinder head 12 to the electrical system of the vehicle. An electro-rheological (E-R) fluid 64 completely fills the metering chamber 26 and the bypass chamber 50. An expansion chamber 66 shown in FIG. 2 is provided in communication with the metering chamber to provide for expansion resulting from a rise in temperature of the fluid. A wire 68 which is heated by an electrical current supplied through an insulated feed line 70 serves to ignite the fuel which is injected into the combustion chamber 11.

In operation of the device, during an engine's compression stroke, the compression from within cylinder head 12 will be transmitted to compression chamber 18 via compression passage 20. Thus the compression pressure will attempt to force the primary piston 24 and the entire ejector rod 22 to a downward position. Unless restrained the secondary piston 32 of injector rod 22 will move into the fuel supply chamber 36 and force the entire fuel supply from supply chamber 36 into the combustion chamber of the cylinder head 12. A timed restraint and release of the injector rod 22 is necessary to permit precisely measured downward movement of the secondary piston 32 into the fuel supply chamber 36 so as to meter the amount of fuel and the timing of its injection into the combustion chamber II in accordance with the needs of the engine.

The restraint and release of the injector rod 22 is accomplished by the application and removal of an electrical potential between electrodes 60 and 62. When applied this potential will substantially solidify the electro-rheological fluid between the electrodes 60 and 62. Thus as best seen in FIG. 2 the injector rod 22 can move only when the electro-rheological fluid is in its fluid state which permits flow between chambers 28 and 30 as the metering spool forces the fluid through bypass chamber 50 via the outlets 52 and 54. Substantial solidification of the electro-rheological fluid 28 between the electrodes when the electric potentia,l is applied will instantly block the fluid flow between chambers 28 and 30, thus preventing further movement of the spool 25 and its associated injector rod elements, and thereby limit the amount of fuel forced from fuel supply chamber 36 into combustion chamber 11.

In a partial throttle or acceleration situation a typical computer controlled system which would be responsive to all criteria necessary for determining fuel flow, such as accelerator position and timing advance, will be connected to the electrical connector 56 so as to provide appropriately timed signals thereto. The air fuel mixture is then ignited by the heated wire 68 or any suitable ignition device.

For a more detailed description of the prior art device of FIGS. 1 and 2 and of the electro-rheological fluid, reference is made to the above-identified parent application, Ser. No. 06/904,378, now U.S. Pat. No. 4,700,678. The E-R fluid is manufactured by the Lord Corporation of 407 Gregson Drive, MacGregor Park, Cary, N.C. 27511. This is to be noted that the E-R material is sometimes referred to as a compound and sometimes as a mixture. From a strict chemical definition it is a mixture and wherever the term compound is used herein it is to be interpreted as a mixture which can be either a solid or a fluid depending on whether a voltage is supplied thereacross or not.

V. OVERALL DESCRIPTION OF THE INVENTION—FIG. 3

It is to be noted that in the example of the present specification describes an ignitiсn system for a four cylinder engine, including the expressions ($T=M_cV^2$) (ms/deg)) and ($Y=ms/180°-T$) in logic blocks 228 and 230 of FIG. 4. For vehicles having other than four cylinders, such as 6 or 8 cylinders the general expression in logic block 230 is $$Y=ms/720°/N-T=N\ ms/720°-T$$

where T=the advance in ms/deg, N is the number of cylinders, and the values T and 720°/N are both measured in the number of 0.01 ms pulse required for the engine shaft to rotate 720°/N at the current angular velocity of the engine shaft and for the advance T. For a four cylinder engine N=4 and 720°/N =180°. It is also apparent the number of distributor devices, such as the Hall effect transistors of FIG. 3, will also change to equal the number of cylinders.

As indicated above the invention is described in terms of a four cylinder engine utilizing CAFI'S (with G.P's) of the type shown in FIGS. 1 and 2 and with the fuel being injected in the cylinder chamber directly through the CAFI and at the glow plug wire. In other forms of the invention the FIE and the fuel injection (FI) means can be separate structures. For example, the FTE, which can be a spark plug or a glow plug, for example, with the fuel injection structure being a different and separate structure and located at a different position in the cylinder chamber but with the fuel being injected towards the FIE to maintain an almost non-stoichiometric mixture of fuel and air. It is to be specifically noted that IID'S employing spark gaps or any FIE can be used in lieu of a glow plug type IID.

Other changes are required to adapt the invention to engines having a number of cylinders other than four. For example, the number of injector controllers (IC'S), to be discussed in detail later herein, must be changed to equal the number of cylinders.

Certain abbreviations are sometimes also used herein as follows:

ECR=engine crankshaft revolution (or rotation)
EC=engine crankshaft
PPD=pulse producing device (such as an HET).
HET=Hall Effect transistor
IC=Injector Controller
FI=fuel injector
FIE=fuel ignition element; ignites the fuel by an ignition source such as an arc or a heated wire or other element
FID=a fuel injector device
GP=glow plug; ignites the fuel by a constantly glowing (caused by heating) element
Z=the parameter updating time; a time interval of 300 ms is used in the 4 cylinder example of the specification
M=the number of degrees of ECR employed to determine the value (ms/Mdeg); M=180° of ECR in the example of the specification.
IID=an injector/ignitor device; includes both a fuel injector (FI) and a fuel ignition element (FIE)
CAFI=compression actuated fuel injector
Mc=a constant in the expression $T=McV^2$ (ms/deg)
Tx=the time interval of fuel injection
AIIC=advance initiate injection computer Referring now to FIG. 3 a decade cascade counter 102 provides the timing for the entire system and consists of a basic 1 MHz clock 102 which divides 1 us pulses into pulse trains sequentially divided by factor of 10 into pulse trains of such as 10 us, 100 us, 1 ms, ms, 100 ms, and 1 second pulse trains, as shown in more detailed diagram of the decade cascade counter 102 of FIG. 3*a*. Such decade cascade counter is sometimes referred to herein as a decade counter or simply as a counter cascade. Counters based on counting cycles other then ten can also be employed in the 20 invention. In FIG. 3*a* the decade cascade counter 102 of FIG. 3 includes a separate section for each stepped-down train of pulses identified by reference characters 102*b*—102*g*, with the master 1 MH clock being identified by reference character 102*a*.

In the specific embodiment of the invention described herein only the outputs from the pulse trains of counter sections 102*c*, 102*d*, and 102*g*, are used and supply, respectively, trains of pulse spaced apart 0.01 ms, 1 ms, and with the 300 ms gating pulse from sectIon 102*g* marking a 300 ms period after the resetting of the entire decade cascade counter to zero by a rotor pulse from HET #1 of FIG. 3. In FIG. 3 each of the sections count to ten and then register one count in the next subsequent section.

Decade counter 102 supplies a pulse train of 0.01 ms pulses to tachometer logic 100 via lead 103. The tachometer logic 100 functions primarily to compute the milliseconds (in the number of 0.01 ms pulses) required for the engine crankshaft to rotate one degree (ms/deg) averaged over the period of the 300 ms gating time interval.

To accomplish the foregoing it is also necessary to know the average angular velocity of the engIne crankshaft whIch rotates twice, or 720°, each time the rotor 109 of distributor 111 rotates once, or 360°. It is apparent that if the number of 0.01 ms pulses occurring during each 720° revolution, or each 180° of the engine crankshaft revolution (ECR) that the ms/deg of revolution of the crankshaft (measured by the number of 0.01 ms pulses) can be computed.

The detailed logic for accomplishing the above computation of ms/deg is shown in FIG. 7 and will be discussed in detail later herein. Assume for the present that such ms/deg computation is done in logic block 100 of FIG. 3.

A sequencer 111 consists cf a rotating magnetized rotor 109 and four Hall effect transistors (HET's) HET #1, HET #3, HET #4, and HET#2, which the magnetized rotor 109 passes as it rotates in a clockwise direction in the sequence listed. It is a characteristic of an HET that when a magnetized rotor (or any magnet) passes thereby a pulse is generated in the HET. The pulses generated in the HET's #1, #3, #4, and #2 are supplied to IC's 105, 107, 108, and 106, respectively, via leads 104, 127, 126, and 129, respectively. These pulses are known as rotor pulses and play an important role in the current invention as will be seen as its details are disclosed in the following specification.

The rotor pulses occurring during each 300 ms time period are first accumulated in tachometer logic 100 and then transferred via lead 130 to the advance/retard logic 118 for computation of the amount of fuel injection advance or retard and tbe duration of fuel injection. Other inputs, such as throttle pulses accumulated during the 300 ms time interval, are also used in the computation of the decision to advance or retard, as will be discussed in detail later herein.

It will be noted in FIG. 3 that the decade counter 102 will be reset to zero via lead 113, decade counter reset logic 115 and lead 219 each time the rotor 109 passes HET #1 after the occurrence of the 300 ms gating pulse. The details of the logic producing the aforementioned timing sequence will be discussed in detail later herein in connection with the discussion of FIGS. 7 and 7*a*.

The foregoing resetting of decade counter 102 to zero is to ensure that the 300 ms gating time period always begins at the time the rotor 109 passes HET #1 and generates what is defined herein as the master timing pulse.

It will be noted later herein that the time of occurrence of the 300 ms gating pulse, marking the end of the 300 ms gating period, is of vital importance in that it initiates the comparison of both the rotor pulses and the accelerator pulses (discussed generally in the following paragraphs) accumulated during the just completed 300 ms time interval with the rotor and accelerator pulses accumulated in the immediately prior 300 ms time interval. As indicated above such comparison is done in the advance/retard computer 118 to determine the advance or retard of the heginning of the fuel injection.

The throttle pulses are generated and accumulated in logic 117 of FIG. 3 at a frequency determined by the degree of depression of the accelerator (shown in FIG. 9). The greater the depression of the accelerator the less the frequency of the generated accelerator pulses which are supplied to a ring counter 170 as discussed in connection with FIGS. 8 and 9 and whose complete count around the ring determines the fuel injection period, thus allowing a greater time period for fuel to be injected into the firing chamber and resulting in more force being generated on the piston during the longer burning period. A more detailed discussion of the relationship between the accelerator pulses, the degree of depression, and their function will be discussed in connection with FIGS. 8 and 9.

It should be noted the time requIred for the acceIerator pulses to count around the ring counter logic 117 of FIG. 3 (which includes the ring counter 170 of FIG. 9) is for the purpose of determining the fuel injection time interval. The accelerator pulses are also accumulated during the 300 ms time interval after the resetting of decade counter 102, and the accumulated total supplied via lead 361 to the advance/retard (A/R) computer 118 of FIG. 3 and to accelerator inputs of the injector controllers (IC) 105–108 of FIG. 3 via lead 440.

Generally speaking, the relative changes in the number of rotor and accelerator pulses occurring during consecutive 300 ms periods parameter updating time intervals determine whether the time of injection of the fueI wIII be advanced or retarded by means of the advance/retard computer logic 118 of FIG. 3 in accordance with the truth table of FIG. 10*a*.

As mentioned above, an important function of the throttle pulse frequency is that it also is the controlling factor in determining the time interval or period of injection Tx of the fuel. More specifically accelerator pulses are supplied to a ring counter contained in IC's 105–108 of FIG. 3 until the ring counter counts around to its starting point in response to the accelerator pulses.

Fuel injection actually begins when the acceIerator pulses are allowed to start the counting of the ring counter and terminates when the ring counter counts around to its starting point. At start up of the engine throttle pulses are allowed to enter the ring counter only after the occurrence of the first rotor pulse following the termination of the prior 300 ms gating time interval The foregoing provides for synchronization of the system.

It is to be clearly understood that the 300 ms time intervals occur cyclically and functicn only to update the system with respect to the advance or retard of the beginning of ignition and the time duration of the fuel injection. This updated information is then used to control the ignition timing of each of the four pistons as the rotor passes by each of the four corresponding HET's. It is to be understood that the beginning and time duration Tx of the fueI injection and the burning thereof remains the same for all four pistons until the next updated information is obtained at the end of the next 300 ms time interval (an arbitrary time interval) and supplied to the ignition controller (IC) logic of the system.

The various signals which control the beginning and duration of the fuel injection period are supplied to the four injection controllers 105, 106, 107, and 108, which are primarily associated with Pistons #1, #3, #4, and #2, respectively. The inputs 140—143 of IC's 105 -108 are supplied to the high voltage input terminals 56 of the prior art IID of FIGS. 1 and 2 in the form of the invention employing such IID's.

It is to be noted that pistons #1, and #4 are companion pistons, as are pistons #2 and #3, a result of normal engine crankshaft construction in that they rise and fall together, i.e. they move together synchronously. Also, they have opposite firing cycles by 180 and have a controlling factor on each other's fuel injection period. The two companion pairs of pistons and their respective HET's operate as companions generally in the following manner. Consider Pistons #1, and #4. As the magnetized rotor 109 of FIG. 3 passes HET #1 in a clockwise direction, a pulse will be generated because of the Hall Effect. Such pulse will be supplied to injector controller 105 via lead 104 to energize a latch in controller 105 which will cause a high voltage to be supplied to the E-R fluid control electrode 56 of FIG. 2, thereby causing the E-R fluid therein to become solidified and preventing the injection of any fuel into the #1 cylinder chamber.

If there is to be an advance a signal will be supplied to the advance/retard input of IC 105 from advance/retard logic 118 (FIG. 3) before the rotor 109 passes HET #3 when piston #1 is at its bottom dead center (BDC) as shown in waveform A of FIG. 6. Assuming the advance to be 12° (an arbitrary figure) the injection of fuel will begin 12° of ECR before rotor 109 passes HET #3 and after a waiting period Y=ms/180°-T after rotor 109 passes HET #1. The fuel injection and burning will then continue for the duration of the fuel injection period to be calculated by ring counter 170 and associated logic of FIG. 9.

On the other hand, if the advance/retard logic 118 calculates that there is to be no advance and Y=ms/180°T, where T=0, then the fuel injection will begin when rotor 109 passes HET #3 at which time a pulse will be generated by the logic of FIG. 9 (to be discussed later herein) which enables the ring counter 170 to receive accelerator pulses, disabling the high voltage to the E-R fluid of the IID and thereby allowing fluid to be injected in cylinder #1. After completion of the ring count the high voltage will be restored and the E-R fluid of the IID of FIGS. 1 and 2 will be solidified so that fuel injection ceases. If T=0 (the retard condition) fuel injection will begin into cylinder #1 as rotor 109 Passes HET #3 (by the logic of FIG. 9). The unlatching of IC 105 which occurs when the rotor 109 passes HET #4 and will permit piston #1 (and IID #1) to go through its exhaust and intake strokes.

It is to be noted that the accelerator of IC 105 of FIG. 3 is the ring counter 170 whose time duration is generally inversely proportional to the degree of depression of the accelerator and determines the time duration Tx of the fuel injection, as discussed generally above, and which will be discussed in more detail in connection with the discussion of FIGS. 5 and 9.

As will be discussed in much more detail later herein the 0.01 pulse train supplied to one input of IC 105 functions to count down to zero the value (in 0.01 ms pulses) stored in the Injection initiate (count down) register 262 of FIGS. 5 and 9 and which was previously transferred thereto from the register 230 of the advance/retard logic of FIG. 4. The time required for the count down of register 262 of FIGS. 5 and 9 determines the amount of advance or a retard condition by signalling the beginning of the fuel injection, all of which will be discussed in general in connection with the following discussion of FIG. 5 and in more detail in connection with the discussion of FIG. 9 later herein.

VI. A GENERAL BUT SOMEWHAT MORE DETAILED DESCRIPTION OF THE INVENTION—FIGS. 4, 5 AND 6

For a somewhat more detailed description of the various major sections of the invention, reference is made to FIGS. 4 and 5 which fit together as shown in FIG. *5a*.

VI.A. DESCRIPTION OF FIG. 4

FIG. 4 shows the broad logic of the tachometer and FIG. 5 shows the broad logic of the injector control (IC) logic and the throttle pulse generating logic.

Referring now specifically to logic block 225 of FIG. 4 there are six inputs supplied thereto to produce an output on cable 122 which comprises the total rotor counts during the 300 ms interval supplied from decade counter 102 of FIG. 3 via lead 103, one of the six inputs to logic block 225.

The four inputs 210–213 are supplied from the four HET'S of sequencer 111 through OR gate 116 and the sixth input lead is supplied to decade counter reset logic 202 from HET #1 of sequencer 111. A second output lead 219 supplies, through logic 202, the signal from HET #1 to reset decade counter 102 of FIG. 3. The rotor pulse sum is supplied from logic 225 via lead 122 to an input of advance initiate injection computer 228 of the injection/advance-retard logic 185 of FIG. 4, and also to the input of rotor count comparator 242 of logic 185.

Logic block 227 (an accumulator and an arithmetic logic device) receives an input signal consisting of a rain of 0.01 ms pulses on input lead 252 from the decade counter 102 of FIG. 3 and then, under control of gates 218 and 220, func ions to compute the number of 0.01 ms/degree of ECR. Gates 218 and 220 are, respectively, an ON gate and an OFF gate with ON gate 218 responding to pulses from either HET's #1 or #4 to enable 0.01 ms pulse accumulator 227 and OFF gate 220 responds to pulses from either HET 2 or #3 to disable accumulator 227 from accepting additional 0.01 ms pulses.

Since the engine craakshaft (EC) rotates 180° during the time the rotor 109 passes from HFT #1 to HET HET #4 to HET #2 the number of 0.01 ms pulses accumulated during each of these two separate periods is the number of 0.01 ms pulses per 180° of ECR (ms/180°). The value ms/180° is then computed from the foregoing data, e.g., the number of 0.01 ms pulses/180° and then transferred to register 230 of injector timer advance/retard logic 185. As indicated above, the logic block 227 also contains divider logic which divides the value ms/180° by 180° to obtain the value ms/deg of engine cranksbaft revolution (ECR) which is then supplied to the computer logic 228 of the injector 5 timer/advance retard logic 185.

The computer 228 of logic section 185 computes the value of the advance T=McV (ms/deg) and the value of the constant M in accordance with the following expressions:

$$i\,F = McV^2/R \qquad \text{(Exp. 1)}$$

$$T = F\,x_2R \qquad \text{(Exp. 2)}$$

$$T = McV^2 \qquad \text{(Exp. 3)}$$

where F=centripetal force,
V(in ms/deg) =velocity of a mass particle at the perimeter of the arc.
r=radius of rotation
T=torque (exerted).

In order to dynamically and continuously compute the value T the mathematical premises set forth herein are adopted.

It is assumed that the sustainable degree of angular advance before the top dead center (TDC) position of the piston for a particular tyPe engine is reached is a function of the force (torque) developed at any given RPM in that particular type engine.

In this analysis T is expressed in degrees, although it is measured in a number of 0.01 ms pulses in the structure of FIG. 4, V is represented by the number of HET sequencer pulses cccurring in a 300 ms time frame, and M is a derived constant for a unique class and type of engine.

A value for T must first be empirically determined (or measured) at a constant RPM. When that value of T is substituted in Expression 3, and also the HET pulses squared ($V^2$) for that value of RPM, the value M can be calculated which then becomes a constant for that engine type and class.

EXAMPLE

Let 15° of ECR be the maximum advance supportable for a given engine at 4500 RPM. and $$T = D_A = \text{degrees of advance}$$

$$\text{where } T = D_A = M\,V^2, \text{ and} \qquad \text{(Exp. 4)}$$

$$V = RPM\,(N/2)Z/60 \qquad \text{(Exp. 5)}$$

where RPM=ECR/minute,
N/2=number of rotor pulses/each ECR, and
Z=the 300 ms time frame, Then, from Exp. 5

$$V = 4500\,(4/2)0.3/60 = 45.0$$

Thus $T=D_A=15=M(45)$
and $M=15°/2025=0.0074$ (a constant)
As another example, let RPM=3000;

$$Then\ V=30$$

$$and\ T=D_A=0.0074\times(30)^2=6.66$$

Reference is made to pages 113 through 128 of a publication entitled PHYSICS—U.S. NAVAL ACADEMY, Edition 1941, by Hausman-Slack and published in 1941 by the D. Van Nostrand Co. publishing company, for a full discussion of the derivation of the expression for T and particularly for the derivation of the value M, and which is incorporated herein by reference in its entirety.

The decision to advance or retard is determined by a comparison of changes in the rotor and accelerator counts at the end of the current 300 ms parameter updating period compared with the number of rotor and accelerator pulses determined at the end of the previous 300 ms parameter updating period in accordance with the truth table of FIG. 10*a*, and is implemented by the logic in block 240 which is shown in detail in FIG. 10, to be discussed later herein.

It is to be noted that rotor and accelerator count comparators 242 and 139 of FIG. 4 both contain logic for storing the rotor and accelerator counts of the previous 300 ms time interval, and comparator means for comparing the present number of rotor and accelerator counts, and with the results thereof being supplied to decision logic 240.

The output of decision logic 240 is supplied to monostable switch 232 to permit or prohibit the transfer of the amount of advance calculated in computer logic 228 to logic 230.

If the calculated advance is permitted to be transferred to logic 230, then such advance will be subtracted from the value ms/180° of ECR stored in logic 230 Logic 230, in addition to including a register for storing the value ms/180°, also contains subtract logic which is capable of, and will, subtract the computed advance T from the value ms/180° to obtain the value y, which is the number of degrees of ECR, measured in a number of first pulses, required after the rotor passes the HET (assumed to be HET #1) of the piston to be fired (assumed to be piston #1) and is computed as follows: (for a four cylinder engine):

$$Y=ms/180°-T$$

The rotor 109 of FIG. 3 must then rotate T degrees of ECR after passing the relevant HET #1 at which time fuel injection and burning thereof begins.

The output Y of logic 230 is supplied to the injection initiate control register 262 of the EC of FIG. 9 of the piston being fired (assumed to be piston #1), as shown generally in FIG. 3, via cable lead 137, and as shown specifically in FIG. 4, via cable 234.

The injection control unit of FIG. 5 consists of a bistable switch 250, a monostable switch 274, a parallel-set injection initiate count down register 262, a ring counter 170, and an SCR activated high voltage generator 284 activated by SCR driver 254.

Consider now the function of decision logic 240 of FIG. 4 and its relation to the interaction of logic 228 and 230 to control the monostable ON switch 232. More specifically, decision logic 240 indicates whether an advance is to be prohibited or allowed In that a retard is to occur by means of comparing the changes in rotor and accelerator counts during the current 300 ms time interval with the rotor and throttle counts accumulated during the immediately prior 300 ms time interval. In the later event (retard) the monostable switch 232 is open (nonconductive) and the advance calculated in computer 228 is not transferred to logic 230. Thus, there will be no subtraction of the calculated advance T in logic 230 and the value y computed in logic 230 will be supplied to injection initiate register 262 of the EC of FIG. 9 will be:

$$Y=ms/180°-(T=0)=ms/180°$$

Accordingly, the fuel injection to cylinder #1 will not begin until the ECR=180° and the rotor 109 passes HET #3 (due to the logic of FIG. 9) when Piston #]is at its TDC, as shown in waveform A of FIG. 6. This fuel injection will continue for the calculated fuel injection time interval $T_x$ (discussed later herein) and which will terminate before piston #1 reaches its bottom dead center (BDC) at time t of waveform A of FIG. 6.

VI.B. DETAILED DESCRIPTION OF FIG. 5

When an advance is required the beginning of the fuel injection begins at the time Y=ms/180°−T before rotor 109 (FIG. 1) passes HET #3, as indicated above.

The injection control unit of FIG. 5 consists of a bistable switch 250, a monostable switch 274 a parallel-aet injectIon initiate count down register 262, a ring counter 170, and an SCR activated high voltage 8enerator 284 activated by SCR driver 254.

The bistable switch 250 is turned on by a latching pulse supplied by an HET, or pulse producing device (PPD), of the sequencer 111 of FIG. 3 associated with the cylinder to be fired. Turn off is made by the unlatch pulse from the companion cylinder (#4 in the example being discussed). Turn on of the bistable switch 250 causes voltage to be supplied to SCR 254 via Iead 256. SCR 254 is already receiving a chopping pulse via lead 280 from the decade cascade 102 of FIG. 3 through the monostable "ON" switch 274. These conditions cause a chopped voltage to be impressed via lead 282 on the primary winding (not shown) of a high voltage transformer in high voltage generator 284. The secondary winding thereof (not shown) supplies the high voltage to the fuel injector terminal 56 (shown in FIG. via lead 286.

At or before the time of turn-on of bistable switch 250 the contents of register 230 of A/R computer 185 (FIG. 4) are traasferred by a transfer enable pulse to the count down register 262 of FIG. 5 which immediately begins to serially count down in response to the 0.01 ms pulses supplied thereto through lead 113 and AND gate 260, and upon the occurrence of a latching pulse being supplied via lead 244 to turn on bistable switch 250 and thereby prime AND gate 260.

At the end of the count down when down-counter-register 262 reaches zero, a signal is supplied which will enable accelerator ring counter 170 via leads 268, and which will disable monostable ON switch 274 prevent the 1 ms pulses on lead 276 from passing through switch 274 to create a chopper pulse train which would then pass through SCR driver 254 via lead 280 to generate a high voltage in high voltage generator 284 via lead 282. The prevention of such high voltage allows the E-R mixture to liquefy, thereby enabling fuel injection to occur.

At the end of the count of ring counter 170 back to its starting point the logic of FIG. 9 will function te disable ring counter 170, thereby preventing additional accelerator pulses from being entered therein until it is again enabled during the next succeeding cycle of firing timing. Also, count down register 262 will be disabled via lead 266 and monostable ON switch 274 will resume its "ON" state via logic 273, as will be discussed in FIG. 9.

Because of the above-described logic and the additional detailed logic shown in FIG. 9, down counter register 262 will be enabled only during the time intervals required to receive the calculated advance and fuel injection data and during the immediately following count down to zero value. Similarly, ring counter 170 is enabled to count only during the time interval beginning with the zero count-down value of counter register 262 and the end of the ring count of ring counter 170.

Accelerator pulses of a variable frequency are supplied to ring counter 170 continuously from a free running capacitor controlled multivibrator 435. The frequency of such accelerator pulses is determined by a variable capacitor 441 of FIG. 9 whose value in turn is controlled by the accelerator rod 437.

As has been noted above, the farther down the accelerator (not shown) is depressed the lower the frequency of the accelerator pulses, thereby increasing the length of time it takes the riag counter 170 to complete the count around its ring and therefor provide a longer fuel injection time interval $T_x$. Other structures can, of course, be devised to derive the time interval $T_x$ from the position of the accelerator.

VI.C. DETAILED DESCRIPTION OF FIG. 6

Timing diagrams showing the general timing relationship of the latching, injection, and unlatching, with respect to the four strokes of the piston, the compression stroke, the power stroke, e.g., the exhaust stroke, and the intake stroke are shown in FIG. 6 for all four pistons. The symbols "BDC" and "TDC" are acronyms for "Bottom Dead Center" and "Top Dead Center," respectively, of the four pistons #1—#4 shown in the timing diagrams A. B, C, and D of FIG. 6. Timing diagram E of FIG. 6 shows the maximum possible advance time and the maximum fuel injection interval for a given engine cylinder.

It is to be noted in FIG. 6 that companIon pistons #1 and #4 rIse and fall together in synchronism as do companion pIstons #2 and #3. However, the injection times of companion pistons #1 and #4 are spaced apart a full revolution (360°) of the crankshaft (or 180° revolution of the rotor) as do companion pistons #2 and #3. Also note that the rise and fall of pistons #1 and #4 in diagrams A and D are displaced from the rise and fall of pistons #2 and #3 by 180° of revolution of the engine crankshaft, as are the fuel injection times. The order of fuel injection can be seen to be spaced apart 180° of the ECR and have the following firing sequence: piston #1, #3, #4, and then #2 as shown in timing diagrams A, C, B, and D, respectively.

The corresponding rotor positions and the amount of ECR are shown at the top of FIG. 6 with respect to the latching, unlatching, and fuel injection for each piston. For example, the #1 piston of diagram A of FIG. 6 is at its BDC when the rotor is passing HET #1 and when the crankshaft is at 0° rotation. At this time the IC of Piston #1 becomes latched (supplying a high voltage to the associated IC) to freeze the E-R fluid and thereby prevent fuel injection at the beginning of the compression stroke.

Piston #4, the companion of piston #1, is unlatched (removing the high voltage to unfreeze the E-R fluid and allow fuel injection) and at its BDC at this initial time and further is at the beginning of the exhaust stroke of piston #4. Pistons #2 and #3 are respectively at their TDC with fuel injection occurring in the cylinder chamber of piston #2 to cause it to enter its power stroke and with Piston #3 also being at TDC and about to enter its intake stroke.

As indicated above, waveform E of FIG. 6 shows the maximum advance, beginning at time t of piston #3 (arbitrarily selected) and with the maximum duration ending at time $t_y$. It is to be noted that if the fuel injection has no advance it will commence at time $t_x$, with a time duration ending not later than the unlatch time $t_z$. The advance can begin at any point between time $t_w$ *and* $t_x$ and the duration of fuel injection can end at any time prior to time $t_z$.

The unlatching at time $t_z$ is significant in that it allows piston #3 to perform its exhaust and intake strokes (no fuel is in the cylinder #3 at this time) and functions to insure the latching of its companion piston #2 in preparation for the compression stroke of piston #2, and to allow the IID #3 (see prior art FIGS. 1 and 2) to return to a condition where more fuel can be stored therein in preparation for its next following compression and power strokes of piston #3 to occur.

In fact, the unlatching of the IC of Piston #3 is caused by the latching of the IC of piston #2 as can be seen graphically from the timing diagrams B and C of FIG. 6, and the logic of FIG. 3 wherein the latching of IC 106, as the rotor 109 passes HET #2, via lead 129, causes the unlatching of IC 107 via lead 129. The unlatching of IC 107 prevents the further generation of a high voltage in IC 107 of FIG. 3, thereby preparing for the injectIon of fuel in the associated cylinder chamber during the next compression stroke of piston #3 when the rotor I09 of FIG. 3 passes H8T #3 again. It is to be remembered that the rotor 109 of FIG. 3 will only pass any HET, including HET #3, once during every two revolutions of the engine crankshaft (ECR). In the four cylinder engine example being employed herein, there are four IID's and four HET's, one for each cylinder.

VII. DETAILED DESCRIPTION OF INVENTION—FIGS. 7, 8, 9, 10 and 10*a*.

A more complete and comprehensive understanding of the organization and interrelation of various parts of FIG. 3 can be obtained by the following consideration of FIGS. 7, 8, 9, 10, and 11.

VII.A. DETAILED DESCRIPTION OF FIG. 7

As mentioned briefly above the tachometer 100 of FIG. 3 functions primarily to continuously update the computation of the ms/deg of each revolution of the engine crankshaft (ECR), with the aid of the rotor nulses, and also to count the rotor pulses over a periodic time interval of 300 ms. The detailed logic of the tachometer 100 is shown in FIG. 7 which will now be described in detail below.

Decade counter 102 of FIGS. 3 and 3*a* supplies a continuous train of 0.01 pulses to input 300 of 0.01 ms pulse accumulator 302. However, such 0.01 pulses are accumulated only during the time periods when the rotor passes between HET #1 and HET #3 and between HET #4 and HET #2, with each period representing 180° of a revolution of the engine crankshaft. It is to be noted that the combination of the HEFT's and the rotating rotor is referred to herein as the "sequencer," and is identified by reference character 111 in FIGS. 3 and 7.

In order to accumulate 0.01 ms pulses only during the time periods that the rotor 109 (FIG. 1) passes between HET's 1 and #3 and HET's #4 and #, it is necessary to disable accumulator 302 of FIG. 7 during the time periods rotor 109 (FIG. 3) passes between HET's #3 and #4 and HET's #2 and #1. This is accomplished by means of logic including sequencer 111, OR gates 304 and 306, and flip-flop (FF) 308.

When a pulse is generated by rotor 109 (FIG. 3) passing either HET #1 or HET #4, flip-flop (FF) 308 is set by such pulse passing through OR gate 304, thereby enabling accumulator 302 and allowing it to begin accumulating the 0.01 ms pulses supplied thereto from decade counter 102. However, when a pulse is generated by rotor 109 passing HET #3 or HET #2, such pulses will pass through OR gate 306 to reset FF 308 and disable accumulator 302 from accumulating additional 0.01 ms pulses. Thus, when the rotor 109 has rotated from HET #1 to HET #3 it has accumulated 0.01 ms pulses over time period equal to 180° of engine crankshaft revolution (ECR) (ms/180°) and then repeats such accumulation between HET's #4 and #2.

In order to compute the ms/deg of ECR it is necessary to transfer each accumulation of ms/180° pulses from accumulator 302 to arithmetlc dividing unit (AU) 310 where the ms/180° is divided by 180° to obtain the ms/deg value. It is to be noted that it is necessary to enable arithmetic unit (AU) 310 to accept the ms/180° accumulated in accumulator 302 and then, by other means, to clear accumulator 302 in preparation for the accumulation of the next group of 0.01 ms pulses as the rotor 109 passes from HET #4 to HET #2.

Such transfer of the contents of accumulator 302 to AU 310 is accomplished by the pulse generated by rotor 109 as it passes HET #3 or HET #, i.e., the pulses appearing at the output of OR gate 306 via lead 312 of FIG. 7. The clearing of the accumulator is accomplished by pulses generated as rotor 109 passes HET #1 and #4 via lead 314 and then supplied through OR gate 304. The calculated ms/deg is then supplied to the advance retard (A/R) logic of FIG. 8 where it is utilized in a manner which will be discussed in connection with the description of the A/R logic of FIG. 8 later herein.

Returning to FIG. 7 the number of sequencer (or rotor) pulses generated during each periodic 300 ms interva! is determined as follows. Assume decade counter 102 has just been reset to zero by a reset pulse 320, (occurring when rotor 109 of FIG. 3 passes HET #1) of timing diagram A of FIG. 7*a* and supplied thereto via and gate 316 lead 113, pulse shaper 334, and lead 219. This reshaped reset pulse from pulse shaper 334 will also set FF 344 (waveform G of FIG. 7*a*) to enable sequencer (rotor) pulse accumulator 100 to accumulate rotor pulses generated as the rotor passes each oi the four HET's of sequencer 111.

When the decade counter 102 (FIG. 3) outputs a pulse 371 marking a time interval of 300 ms after being reset, as shown in waveform B of FIG. 7*a*, such 300 ms time interval marking pulse (which itself has a duration of 100 ms, also as shown in waveform B of FIG. 7*a*,) is supplied to the reset input 320 of FF 344 (and also to the set input 322 of FF 326), with the trailing edge 373 (waveform B of FIG. 7*a*) resetting FF 344 which had been previously set by the cascade reset pulse. It is to be noted specifically the 300 ms time period is measured by the trailing edge of the second pulse in the 100 ms pulse counter section of the decade counter, each of which pulses is 100 ms in length. The trailing edge of the second 100 ms pulse occurs when the decade counter has counted through 100 ms three times. Rotor pulse accumulator 100 will accumulate rotor pulses during the time period of 300 ms when accumulator 100 is activated.

The next decade counter reset pulse following the 300 ms period discussed immediately above cannot be generated either immediately upon the termination, or overlap the termination, of the current 300 ms period in order to avoid a race condition. More specifically the beginning of a new 300 ms time interval or period must be delayed until the completion of the necessary computations (following the preceding 300 ms time interval) which are required to determine whether an advance or a retard is required and also the duration of the injection time of fuel. A premature rotor pulse from HET #1 (pulse 374 of waveform D of FIG. 10) could otherwise cause a premature beginning of a new 300 ms period.

To avoid such a timing conflict with a resulting mistiming, a 10 ms length pulse 373 (waveform C of FIG. 7*a*) is selected from the decade counter 102 which immediateIt follows the 300 ms gating pulse 371 as shown in waveform C of FIG. 7*a*. This 10 ms pulse is supplied to one of the two inputs of OR gate 330 along with the set output of FF 326 (waveform D of FIG. 7*a*.)

It will be recalled that the decade counter 102 cannot be reset to begin generating another 300 ms pulse until after rotor 109 passes HET #1 in order to maintain the proper timing of the system which will become cIearer in connection with the dIscussIon of the A/R logic of FIG. 8 later herein.

To accomplish the foregoing, any cutput pulse from OR gate 330 will inhibit the occurrerce of a decade counter rest pulse from AND gate 316 as shown in waveforms F and G of FIG. 7*a* where the output pulse 375 of AND gate 216 cannot begin until after the termination of the 10 ms pulse 372 (waveform C). The occurrence of the trailing edge 370 of the pulse 371 of waveform B of FIG. 7*a* to reset FF 344 must aIso occur before the rotor pulse from HET #1 can pass through AND gate 316.

In summary, the inhibition of a decade reset pulse from AND gate 316 will exist during the 300 ms period, and the immediately following 10 ms period, thereby preventing a master rotor pulse, which occurs when rotor 109 (FIG. 1) passes HET #1, from passing through AND gate 316 during the existence of the 300 ms period followed by a 10 ms period. It should he noted that AND gate 316 is primed by the resetting of FF 324 upon the occurrence of the trailing edge 370 of the 100 ms gating pulse 371 and would pass the master HET #1 pulse except for the inhibiting effect of the output or OR gate 330. In the event a master rotor pulse from HET #1 begins during the 10 ms pulse 372 (waveform C of FIG. 7*a*) foIlowing the 300 ms gating period, as shown in waveform E cf FIG. 7*a* and then terminates after the expiration of the 10 ms pulse, the pulse shaper 334 is provided to reshape that portion of the master rotor pulse (pulse 375 of waveform F of FIG. 71) which passes through AND gate 316 into the wider, reshaped pulse 376 of waveform G of FIG. 7 to insure that it will be sufficient to reset cascade counter 102 and set FF 344. Also, in FIG. 7, the sequencer pulses from HET's

#1, #3, #, and #4, as the rotor passes by each HET, are supplied respectively to IC's 105–108, as in also shown in FIG. 3, and for the purposes described in the above discussion of FIG. 3.

VII.B. DETAILED DESCRIPTION OF FIG. 8

Referring now to FIG. 8 which is a detailed description of the logic of the advance/retard logic 185 of FIG. 4 the set and reset outputs of FF 344 of FIG. 7 are supplied to FIG. 8 via leads 342 and 340 where they are each connected to a number of inputs. Essentially, the signals appearing on leads 342 and 340 perform, enable and disable functions as will be discussed in detail along with the following discusslon of the logic blocks of FIG. 8 and their interrelation.

As discussed above, the number of rotor pulses accumulated in accumulator 100 of FIG. 7 during each 300 ms interval of time is supplied to the advance initiate injection computer (AIIC) 346 of FIG. 8 via lead 345 by means of a transfer enable pulse supplied to transfer enable input 358 of AllC 346 of FIG. 8 via lead 340 upon the resetting of FF 344 of FIG. 8. Also the value ms/180° accumulated in register 302 of FIG. 7 and the ms/deg calculated in divider logic 310 of FIG. 7 are supplied via leads 350 and 352, respectively, to subtract logic 354 and AIIC logic 346 of FIG. 8, respectively, upon the transfer enablement of logic blocks 354 and 346 of FIG. 8 by the enabling signals appearing on leads 342 and 340, respectively, and which are supplied to transfer enable inputs 356 and 358 of logic blocks 354 and 346, respectively, of FIG. 8.

Consider now the function of each of logic blocks 354 and 346. Logic block 346 comprises computer logic which computes the advance value $T=M_c^2$ in (ms/deg), where $M_c$ is a constant which is determined empirically for each of the various types of automobile engines made today and is determined by the number of cylinders, the cubic displacement of each cylinder, and other parameters as will be discussed in detail herein.

Assume firstly that there is to be an advance which is determined by the logic below the dashed line 369 in FIG. 8 (and to be described later herein) and which controls the normally ON monostable switch 232 through AND gate 357.

In response to the decision to advance the subtract logic 354 will subtract the value T (the amount of advance) from the value ms/180° in subtract logic 354. Switch 232 will be conductive to pass the value T to subtract logic 354. As will be recalled the value ms/180° is obtained from register 302 of FIG. 7 via lead 350.

Using piston #1 as an example, it is necessary to subtract T from ms/180 since the advance timing for the firing of piston #1 begins at a time T before the rotor passes HET #3. More specifically, fuel injecticn and ignition thereof will not begin until piston #1 approaches its TDC which occurs as rotor 109 approaches HET #3. When the rotor is T time before passing HET #3, which is Y=ms/180° −T time from the time the rotor passed HET #1, fuel injection and ignition thereof will begin. Worded in another manner, injection and ignition of the fuel will not begin until the ignition initiate down counting register 262 of FIG. 9 is down counted to zero which, in the case of an advance, occurs before rotor 109 reaches HET #3 or, in the case of a retard, occurs when the rotor passes HET #3 for reasons set forth generally below.

The foregoing is shown more clearly in sequencer 111 of FIG. 3 wherein timing begins as rotor 109 passes HET #1 but firing does not begin until rotor 109 reaches the angular position indicated by radial line 121 (FIG. 3) which is 12° (of ECR) before rotor 109 reaches HET #3.

Since the engine shaft has rotated 180° during the 9020 angular rotation of rotor 109 between HET #1 and HET #3, and since fuel injection into cylinder #1 has been calculated to begin 12° of ECR before rotor 109 reaches its TDC as it passes HET #3, it is necessary to subtract T (in ECR degrees of rotation) from 180° of ECR degrees of degree, resulting in 168° of ECR (or 84° of rotor 109 rotation measured from the time rotor 109 passes HET #1). Thus, initiation of fuel injection will begin 12° of ECR or 6° of rotor rotation before the rotor passes HET #3, as shown by radial 121 of sequencer 111 of FIG. 3. If there were no advance, but rather a retard was called for, the rotor 109 (FIG. 3) would have to rotate through a full 180° of ECR or 90° of rotor revolution and fuel injection would begin as rotor 109 (FIG. 3) passed HET #3.

It should be noted that the output of subtract logic 354 of FIg. 8, which is in 0.01 ms pulse/180° of ECR minus the value T, is always supplied via output lead 334 to count down register 262 of FIg. 9 which then immediately begins to count down to zero, at which time fuel injection begins in a manner determined by the accelerator position, as will be discussed in detail in connection with FIG. 9. Thus, if T is not subtracted from ms/180° in substract logic 354 of FIG. 8, count down register 262 must count down a full 180° of ECR in 0.01 ms pulses, and there will be no advance. The fuel injection will begin as rotor 109 passes HET #3 which will occur after 180° of ECR or 90° of rotor rotation.

On the other hand, if T is subtracted from the value ms/180° in subtract logic 354 the resuIt entered into count down register 262 of FIG. 9 will be less than 180° of ECR in 0.01 ms pulses and an advance of T (in 0.01 ms pulses) will occur. The fuel injection will then begin before rotor 109 (FIG. 3) passes HET #3.

Ignition of the fuel will begin immediately upon the beginning of fuel injection and will continue for the calculated duration of fuel injection which is determined by the throttle pulse frequency as will be discussed in more detail in connection with FIG. 9.

When rotor 109 (FIG. 3) passes HET #3 it will create a pulse which will latch IC 107 of FIG. 3 and initiate the timing of the ignition cycle of the fuel in cylinder #3. Piston #3 will be at its BDC, as shown in waveform C oi FIG. 6. Assuming the advance and fuel injection interval to remain the same as for the firing of piston #1, fuel ignition in cylinder #3 will begin 12° (of ECR) before rotor 109 reaches HET #4. Also, as rotor 109 passes HET #3, EC 106, associated with the companion HET #, will be unlatched allowing piston #2 to go through its exhaust and intake cycles between times $t_1$ and $t_3$ of waveform B of FIG. 6.

As indicated above, at the end of the next 300 ms time interval, newly calculated parameters of the advance (or retard) and the duration of fuel injection will be supplied to the iour lC's 105, 106, 107, and 108 of FIG. 3.

The four outputs 140, 141, 142, and 143 of IC's 105, 106, 107, and 108, respectivaly, as mentioned above, supply a high voltage to the high voltage inputs 56 of the four CAFI'S of the type shown in FIGS. 1 and 2 of the previously mentioned patent application Ser. No. 904,378 to freeze the E-R fluid therein and thereby prevent injection of fuel into the associated cylinders. In the absence of such high voltage the four CAFI'S of FIGS. 1 and 2) will permit the fuel tc be injected into the cylinder firing chambers.

Such supplying of high voltage is supplied to the terminals 56 (FIG. 2) of the four CAFI'S (FIGS. 1 and 2) in accordance with the waveforms of FIG. 6, when the CAFI'S are in an unlatched condition, and is removed from the CAFI'S when the CAFI'S are in a latched condition, as shown in the waveforms of FIG. 6.

Consider now the case where a retard condition rather than an advance condition is required. Switch 232 will be non-conductive and the output of subtract logic 354 of FIG. 8 will be the value ms/180° (In 0.01 ms pulses), sInce the value T cannot he subtracted therefrom due to the non-conductivity of switch 232. Therefore, a high voltage will be supplied to the terminals 56 (FIG. 2) of the four CAFI's of FIGS. 1 and 2 when the count down register 262 of FIG. 9 counts down from 180 to 0, discussed briefly above and which will be discussed in detail later herein in connection with the discussion of FIG. 9.

When count down register 262 has counted down to 0° from 180° (of ECR in 0.01 ms pulses), the rotor 109 of FIG. 3 will be passing HET #3, as disctssed above.

The logic below the dashed line 369 in FIG. 8 will now be discussed As indicated above such logic controls the decision to cause switch 232 of FIG. 8 to be either conductive (ON) or non conductive (OFF). Basically, the logic below the dotted line 369 periodically accumulates the totaI numher of rotor and acceIerator pulses over a given time interval Z, which wiil be assumed to be 300 ms in the present example of operation, in registers 100 and 341, respectively. These accumulated rotor and accelerator pulses will then be compared in comparators 357 and 343 and the total number of rotor and accelerator pulses accumulated in the immediately prior 300 ms time interval. The relative changes in the number of rotor and accelerator pulses are then compared and processed in decision logic 240 in response to the signal appearing on one of the three outputs of the two comparators 357 and 343 which will indicate whether the number of rotor and throttle pulses have each decreased, remained constant, or increased.

Then, in accordance with the truth table 380 of FIG. 10*a* either a permit or a prohibit output signal wiIl be generated on either the output lead 339 or the output lead 343 or OR gate 312 or 314, respectively, as will be discussed in more detail in connection with the description of FIG. 10.

Comparators 357 and 343 are enabled at the end of the 300 ms time interval which resets FF 344 of FIG. 7, with the reset output being supplied to the enable inputs of comparators 357 and 343 via lead 340. When the next decade reset pulse occurs FF 344 (FIG. 7) is set to cause the transfer of the contents of rotor pulse register 100 and throttle pulse register 341 to registers 353 and 345, respectively, via leads 367 and 344, in preparation for a comparison of the next accumulation of rotor and throttIe pulses in registers 100 and 341 after the next 300 ms time interval updating period.

VII.C DETAILED DESCRIPTION OF FIG. 9

The injection control unit of FIG. 9 which uses the same reference characters used in FIG. 5 to identify corresponding elements, consists of a bistable switch 250, a monostable switch 274, a parallel-set down counter register 262, a ring counter 170, and a high voltage generator 184 activated by SCR driver 254.

The bistable switch 250 is turned on by a latching pulse via lead 244 from the sequencer associated with the cylinder to be fired. Turn off of bistable switch 250 is caused by the unlatch pulse from the HET of the companion cylinder via lead 246. Turn on of bistable switch 250 causes an output voltage to prime AND gate 260, and to prime SCR 254 via lead 256. SCR 254 also is receiving a 1 ms chopping pulse via lead 280 from the decade cascade counter 102 of FIG. 3 through the monostable "ON" switch 274. These conditions cause a chopped voltage to be impressed, via lead 282, on the primary winding of a high voltage transformer in high voltage generator 284. The secondary winding thereof supplies the high voltage to the fuel injector (not shown in FIG. 9) via lead 286.

At the time of turn on of bistable switch 250 the contents of register 234 of A/R computer 185 (FIG. 4) are transferred by a transfer enable pulse 420 of waveform A of FIG. 9*a* (via lead 334) to the count-down register 262 of the IC of FIG. 9, which immediately begins to serially count down (as indicated in waveform B of FIG. 9*a*) in response to the 0.01 ms pulse train supplied thereto through lead 113 and AND gate 260 of FIG. 9, upon the occurrence of a latching pulse being supplied, via lead 244, to turn on bistabIe switch 250 and thereby prime AND gate 260.

At the end of the count down, when counter-register 262 reaches zero, a signal is supplied which will set FF 488 (waveform E of FIG. 9*a*) to enable throttle ring counter 170 via enable input 490, to disable monostable ON switch 274 via lead 272 to prevent the 1 ms pulses on lead 176 from passing through switch 274 to create a chopper pulse train which would then pass through SCR driver 254 via lead 280 to generate a high voltage in high voltage generator 284 via lead 282 and finally, to set FF 489 (waveform F of FIG. 9*a*) to clear and disable down counter-register 262 until the next transfer enable pulse (from subtract logic 354 of FIG. 8) is supplied via lead 334 to reset FF 489. Also, when down counter 262 reaches zero, FF 420 is reset to disable AND gate 260 and thus disable count down register 262.

At the end of the count of ring counter 170 back to its starting point an output is supplied from terminal 495 of ring counter 170 via lead 492 to reset FF 488 and to disable ring counter 170, thereby preventing additional throttle pulses from being entered therein until ring counter 170 is again enabled during the next succeeding cycle of firing timing. Also, monostable ON switch 274 resumes it "ON" state.

Because of the above-described logic, down counter register 262 is enabled only during the time interval required to receive the calculated advance and fuel injection data and during the immediately following count down to zero value (waveform B of FIG. 9*a*). Similarly, ring counter 170 is enabled to count only during the time interval $T_x$ (which is the fuel injection time interval) beginning with the zero count down value of counter register 162 and terminating at the end of the ring count (waveform C of FIG. 9*a*).

Throttle pulses of a variable frequency are supplied to ring counter 170 (and to throttle count pulse register 341 of FIG. 8) continuously from the free running multivibrator 435 of FIG. 9. The frequency of such throttle pulses is determined by variable capacitor 441 whose value in turn is controlled by the position of throttle rod 437.

As has been noted above the farther down the accelerator is depressed the lower the frequency of the accelerator pulses, thereby lengthening the time $T_x$ it takes the ring counter 170 to complete the count around its ring and thereby lengthening the fuel injection time interval $T_x$.

VIII. ALTERNATIVE FORM OF THE INVENTION

As an alternative form of the invention a spark gap, or other suitable fuel ignition element, can be employed as the ignition agency rather than the heat generating glow wire 68 of prior art FIGS. 1 and 2 with the use of additional logic of FIG. 9 which comprises monostable OFF switch 496, SCR high voltage driver 497, and high voltage generator 498, and the substitution of appropriately spaced electrodes similar to those of a conventional spark plug in lieu of the glow wire 68 shown in FIGS. 1 and 2.

The electrodes can be connected to the same wires as is the glow wire 68 but need be supplied an arc-producing voltage only at the beginning of the time interval that fuel injection occurs. The foregoing is accomplished by monostable OFF switch 496, which is normally off, to prevent a high voltage from being developed in SCR high voltage driver 497. It is to be noted that when monostable OFF switch 496 is off, resulting in a high voltage not being supplied to an ignition spark gap via lead 499, monostable ON switch 274 is on, thereby permitting the generating of a high voltage to cause the E-R fluid to become frozen, thus preventing fuel injection to occur.

On the other hand when switch 274 is off, thereby permitting fuel injection to occur, switch 496 is on, thereby allowing a high voltage to be developed which is supplied across the electrodes (provided in lieu of the glow wire 68) to create a spark during the iuel injection period which ignites the fuel.

At the bottom of the power stroke of the engine cylinder the unlatch pulse is received from its companion cylinder turning off the bi-stable switch 250 via unlatching lead 246 and removing power from the SCR'S to de-energize the injector. The injector return spring (see FIGS. 1 and 2) returns its piston to the initial position thereby pulling in additional fuel in preparation for its next operation.

X—DISCUSSION OF FIG. 10

15 FIG. 10 shows a detailed diagram of suitable logic for implementing the function requIred by logic block 140 of FIG. 8. In FIG. 10 the dashed line block 140 is divided into a prohibit advance logic portion 324 and a permit advance portion 322, both portions functioning in accordance with the truth table of FIG. 10*a*.

It is apparent from an examination of FIG. 10 that the two AND gates 316 and 318 each will produce an output when either of the prohibit conditions of FIG. 10*a* exist. Either of such outputs will pass through OR gate 314 lead 339 and then to AND gate 357 to turn off monostable ON switch 132 and thereby prevent the calculated advance T from being subtracted from 180° of ECR.

Similarly, either of the two permit conditions of the truth table of FIG. 10*a* will produce an output from one of the two AND gates 306 or 310 which will pass through OR gate 312, lead 343, and then to the inhibit input of AND gate 357 of FIG. 8 to prevent the turning off of switch 132 and thereby allow the calculated advance T to be subtracted from the value ms/180°,

X.—DETAILED DESCRIPTION OF IMPROVED FUEL INJECTOR/IGNITOR—FIGS. 11, 12, 13, 14, 15, 16, and 17

XA—DETAILED DESCRIPTION OF FIG. 11

An alternative and improved form of a fuel injector (FI) which can be employed in lieu of the FI of FIGS. 1 and 2 and with the unmodified electronic control logic of FIGS. 3 through 10*a* is shown in FIGS. 11–17.

A primary advantage of the FI of FIG. 11 lies in the use of a plurality of closely spaced open ended concentric cylindrical rings (OEC'S) 510 which are positioned concentrically around rod 512 and which overlap each other over most of their axial length, thus providing for near maximum adjacency of the inside and outside surfaces of each OEC with the surfaces of the adjacent OEC'S.

Such maximum adjacency of the OEC surfaces provides a much greater frictional gripping force between adjacent OEC surfaces and the E-R normally fluid mix.ure (when soIIdified and much greater shear strength of the solidified E-R mixture) which fills the FI from the fuel supply cavity (FSC) 612 at the top of the FI to the spring loaded rod supporting base (BASE) 562 near the bottom of the FI and including specifically the spaces between the concentric OEC'S as discussed in more detail below. The BA8E and its operation and function will be described in detail later herein.

E-R mixture can be seen to completely fill the spaces between two groups of OEC'S 514 and 516, which are alternately positioned with respect to each other around the rod 512.

When an E-R solidifying voltage is supplied to the alternately positioned OEC'S 516 while the remaining OEC'S 514 remain at ground potentiaI there will result six cylinders of solidified E-R fluid formed between the six OEC'S 510 and the rod 512.

It is of substantial significance to increase both the total shear strength of the solidified E-R fluid and the total frictional area between adjacent OEC'S and the rod 512 of FIG. 11 over the RI structure of FIGS. 1 and 2 pressures generated in the cylinder chamber (CC) will force rod 512, OEC's 514 and 516 and control body assembly (CBA) 520, including the cylinder wall 524 therein to move upwardly to cIose the port 526 at the top of cylinder wall 522 and thereby cause the piston cavity 528 to becomes sealed, thus preventing further movement of piston 518 and thus the rod 512 into the fueI supply cavity (FSC) 530.

When the rod 512 is prevented from moving further into fuel supply cavity FSC 530 the pressure in FSC 530 is immediately reduced to a level whereby no additional fueI can be forced into port 532 of rod 512 and then through rod bore 534 into the (CC) 538. Fuel injectIon is thus terminated. More specifically, when the solidifying voltage is supplied to OEC's 514, the ER fluid with the spaces between the OEC's become solidified and the increasing (CC) pressure forces the control body assembly (CBA) 520 including the rod 512, the piston 518, and the movable cylinder wall 524 upwardly past the fixed cylinder wall 522 to seal the piston cavity 528 and stop further movement of rod 512 into FSC 530.

The termination of fuel injection is thus controlled solely by the generation of the solidifying voltage by the electronic control circuit discussed herein and shown in FIGS. 3–10*a*.

When the fuel injection is terminated the solidifying voltage is removed from the three OEC'S 514 and the springs 538 and 540 force control body assembly (CBA) 520 and the rod 512 downwardly into their normally lowered position which lowers the rod ports 532 out of the F8C 530 and also carries the (CBA) 520 downwardly into its normal position in preparation for the next cycle of operation.

It should be noted that when the E-R mixture is liquefied and the rod 512 moves downwardly out of the FSC 530 along with (CBA) 520 the compression is removed from spring 538, thereby allowing the valve 546 to open and fuel to flow into (FSC) 530 through the now open check valve 546, also in preparation for the next cycle of operation. The port 532 in the upper portion of rod 512 will now have been moved out of the (FSC) 530 under the above described conditions so that fuel cannot flow down the bore 534 of rod 512 and into the CC 639.

Further, when the solidifying voltage is removed from OEC's 514, the rod 512, and the attached piston 518 are lowered to their lowest position and the tapered spring 538 in piston cavity 528 will return to its non-compressed state so that check valve 542 will become opened to allow the fluid E-R mixture to enter the piston cavity 528 and also into the space above the spring loaded ring 548 through ports 550, 526, and 552. The ports 526 and 552 became aligned when the CBA 520 including the cylinder 524, were lowered to their lowest, and normal, position, as shown in FIG. 11.

With the pressure of the trapped fluid E-R mixture removed therefrom the spring loaded ring 548 in Control Body Assembly (CBA) 520 will move upwardly to the position shown in FIG. 11 and will thus block ports 550 and 556 in the outer shell of (CBA) 52C to prevent flow of the fluid E-R mixture into the (CBA) 520, including the cavities 528 and 558 above and below the piston 518.

The blocking of the ports 556 and 550 in the outer shell of the (CBA) 520 during the time the E-R mixture is in solidified form (when the voltage is applied thereto) prevents the increasing pressure in the (CC) 639, which occurs both during the burned fuel fumes exhaust cycle and particularly the fresh air compression cycle from being transmitted into the top piston cavity 528 to thereby prevent the piston 518 from rising to seal and close the check valves 542 and 546.

Closure of valve 542 seals the piston cavity 528 except for port 552 so that as the piston 518 (and rod 512) rise still further, the pressure created in piston cavity 528 will not be dissipated by an open valve 542 but will act to pass the fluld E-R mixture through ports 552 and 526 to move the spring loaded ring 548 downwardly to allow the liquid E-R mixture to pass freely from both the piston cavities 528 and 558 above and below the piston 518 and thereby allow free upward movement of piston 518 (and rod 512) within the fixed cylinder wall 522 until the solidifying voltage is again applied to the OEC'S and the entIre CFA including the cylinder wall 524 is caused to move upwardly to misalign ports 526 and 552, thus sealing the upper piston cavity 528 to freeze the movement of piston 518 and also the rod 512, thereby terminating fuel injection. Normally closed valve 542 is always seated except when there is a cavitation in chamber 528 due to the rapid return of piston 518 to its initial position.

It should be noted that the E-R solidifying voltage solidifies only the E-R fluid mixture between the two sets of three OEC'S 516 and 514 but that the E-R mixture remains fluid at all times in or around the CBA 520 or around the ceramic insulator 590 in FIG. 11. Combustion or ignition of the fuel cannot occur during application of the solidifying voltage to the OEC'S 514; but only during those time intervals when the solidifying voltage is not applied to high voltage input lead 656 and thus to OEC'S 514, as discussed in that part of the specification directed to the electronic control circuit of FIGS. 3–10*a*.

As indicated generally above, fuel injection is initiated when the solidifying voltage is not applied to OFC'S 514 and when pressure in CC 639 has risen sufficientIy to force the piston 572 upwardly against spring 540 sufficiently to move the port 532 in rod 512 into the FSC 530, which is called the triggered position, shows the piston 518 raised a short distance to close the valve 542. The triggered position occurs when the E-R solidifying voltage is removed from the OEC'S 516 of FIG. 11. The movement of rod 512 into FSC 530 closes valve 546 (FIG. 11) and creates a pressure within FSC 530 which forces fuel into rod port 532 and down the bore 534 intc CC 639 where it is ignlted by the spark across electrodes 586 and 584.

During the operation of the FI the total volume therein experiences certain changes. To compensate for these changes there is provided a volume compensator 655 which can be primarily a bellows type arrangement, or other suitable type volume compensators.

Referring now to the lower portion of the FI, as shown in FIG. 11 there is shown the structure which supports the rod 512 in a spring loaded manner and the structures which support the non-grounded OEC'S 516 which in turn support the CBA 520. Together, the above two support systems form what is referred to herein as the spring loaded rod base support system (BASE).

Consider first the spring loaded system which supports the rod 512. The rod 512 can be seen to extend downwardly through the six 0EC'S 514 and 516, the insulator sleeve 566, the metal sleeve 568 which lies against the insulator sleeve 566, which is attached to the rod 512. The shock absorbing cup-like element 596, attached at the seal 570, and then through a normally only slightly compressed spring 540 which is contained at the top end of seal 570 and at the bottom end by piston 572 at the top surface of which the rod 512 abruptly narrows to form a shoulder which rests on the top surface of piston 572, with the narrowed portion 578 of the rod 512 passing through the center bore 574 of piston 572. A circular check valve 576 is secured to the narrowed portion 578 of the rod 512 with the flat top surface thereof covering the exhaust ports of the piston 572.

The narrowed portion 578 of rod 512 (with the bore still extending therethrough) extends downwardly from element 572 and terminates in Venturi tube 580, which functions to mix fuel and air at the exit 582 of rod 512 as the fuel is forced out of the end of rod 512. ignition of the mixed fuel and air occurs between the high voltage electrode 584 and the grounded electrode 586. The Venturi tube 580 and the high voltage electrode 584 are both secured to an insulative sleeve 588 which extends from the hottom of the FI up to the bottom of the grounded cylindrical base structure 662 which rests on the shoulder 592 of the narrowed portion 594 of the outer shell of the FI.

It is to be noted that the spoked base element 602 is secured to the bottom edge of the non-grounded outer OEC 598 with the top edge of the outer OEC 598 being secured to the bottom wall 600 of C8A 520.

The remaining two grounded OEC'S 604 are secured only at their top edges to the bottom surface 600 of spokes 638, 640 and 642 of C8A 520. On the other hand only the bottom ends of the three remaining OEC'S 516 are connected to the spokes of the high voltage element 606, which is separated from the first element by an insulative gap 608 to electrically insulate the base element 606 from the base element 602. The base element 606 has a shoulder which rests on the insulator sleeve 566 and thereby maintains the gap 608 between the two base elements 606 and 602 through both of which the rod 512 passes.

It is noted that when the rod is first pushed up by an increase in pressure in CC 639, element 576 will cause piston 572 to move upwards which in turn will compress spring 540 to cause rod 512 to move upwardly, carrying with it the three OEC'S to which the solidifying voltage is applied and which are secured rigidly to rod 512 which passes through ceramic element 590 and seal 570. However, when the solidifying voltage is applied to OEC'S 516 to solidify the E-R mixture, the entire assembly including the six OEC S and the rod 512 become a solid unit and move upwardly together, pushing the CBA 520 upwardly along as part of the solidified unit.

As a safety mechanism when the pressure in CC 639 reaches a certain level the piston 572 will be forced upwardly until the extreme bottom 680 (FIG. 11) of piston 572 is above the port 660 which will allow the pressure in CC 639 to flow through port 660, and then through port 682 into the space around spring 540 and upon the top surface of piston 572, thus equalizing the pressure on the top and bottom surfaces of piston 572 so that pistcn 572 will not be forced upwardly any farther. Consequently, the upward movement of rod 512 has a definite safe limit. Located concentric within spring 540 is spring-loaded anti-siphoning ball cbeck 690.

Referring now to FIGS. 12, 13, 14, 15, and 16 there are shown views of the cross sectional areas A—A, B—B, C—C, D—D, and E—E respectively of FIG. 11, each of which is designed primarily to show the main functions of the cross sectional structure shown. Firstly, each cross sectional view shows the functional structure itself and also the means by which it is supported in the FI. Secondly, each cross-sectional view shows the means by which the fuel is allowed to flow freely between the various structural elements.

X. B. DETAILED DESCRIPTION OF FIG. 12

Consider first FIG. 12 which shows section A—A of FIG. 111. In FIG. 12 the rod 512, with the bore 534, is shown at the center thereof. Next, the open channels 610 in the otherwise solid element of fuel supply cavity enclosure 612 are shown which lead to the cylindrical spacing 614 between the solid element and the metal outer shell 616 of the top portion of the FSC enclosure 612 of the FI. The outer she1I portion 616 is required to provide support for the rod 512 and to provide a low pressure fuel reserved by means of threaded ring 618 and bored out and threaded nut 620 (FIG. 11).

X. C. DETAILED DESCRIPTION OF FIG. 13

Referring now to FIG. 13, there is shown the cross-sectional view B—B of FIG. 11. Outside the rod 512 and its bore 534 a series of channels 622 arranged in a spoke-like manner form a central cylindrical chamber 624 allows the fluid E-R mixture to flow freely from the cylindrical channel 626 through the ring-like channel 631, the spoke-like channels 622, the second ring-like chamber 624 and through the valve 542 (FIG. 11), when opened to the FSC 530. It is to be noted in FIG. 11 that the cylindrical channel 626 extends downwardly between the CBA housing 520 and the FI housing 628 to the top surface of element 590 and passes ports 550 and 556 in the wall of the CBA housing 520.

When the spring loaded ring 548 of FIG. 11 is forced downwardly by the pressure in piston cavity 528 of CBA 520, the port 556 in the CBA housing 520 is opened, allowing the fluid E-R mixture to flow down through the spring 630 and the openings in the bottom of the CBA housing 520 and then in between and around the six OEC'S 514 and 516. A cylinder 650 of ceramic lies inside and adjacent to the cylindrical outer shell of the FI housIng 628.

X. D. DETAILED DESCRIPTION 0F FIG. 14

In FIG. 14, which shows the cross sectional area C—C of the FI of FIG. 11, the bottom 600 (FIG. 11) of the CBA housing is shown which has three openings 632, 634, and 636 therein separated by three spoke-like struts 638, 640, and 642 which securely connect the inner OEC'S 604 (FIG. 11) to the outer wall of the CBA 520, thereby supporting the OEC'S 604 in a fixed position. Similarly, outer OEC 598 is secured to struts 638, 640, and 642 to secure OEC 598 in a fixed position. The two cylinders 644 and 646 are, respectively, the cylinder 524 and the outer shell or housing of CBA 520, with the cylindrical channel 626, the cylindrical ceramic element 650, and the cylindrical outer housing 628 being shown next in the order listed. The two electrical conductors 656 and 654 respectively carry the solidifying voltage and spark gap voltage to OEC'S 514 and OEC'S 516, respectively.

X E. DETAILED DESCRIPTION OF FIG. 15

In FIG. 15, which shows the cross-sectional area D—D of FIG. 11, a spring 540 is shown positioned between rod 512 and cylindrical element 658 which has a plurality of grooves 660 therein to allow entrapped gas seepage to exit through check valve 576. Outer cylindrical ring 662 is the FI housing or outer shell.

X F. DETAILED DESCRIPTION OF FIG. 16

In FIG. 16, which shows the cross-sectional area EE of the FI of FIG. 11, the narrowed rod 512 (or 578) extends partially through a Venturi tube 580 which is supported by struts 664 and 666 to the ceramic cylinder 668. The hot spark electrode 584 (FIG. 11) is also supported by the ceramic cylinder 668.

X. G DETAILED DESCRIPTION OF FIG. 17

FIG. 17 shows the release of the fluid block in piston cavity 528 as it existed in FIG. 11 with ring 548 closing ports 550 and 556. The pressure in CC 639 created during the compression stroke of the engine piston forces the rod upwardly, as shown in FIG. 17 to enter FSC 530, FIG. 11, along with rod port 532, to close the valve 546, ring 548 is forced downwardly to align ports 552, 526, and 550 to allow the E-R fluid to flow out of piston cavity 528 and permit the piston 518 to rise and push rod 512 further into FSC 530 to force fuel down rod bore 534 to CC 639 where it is burned.

XI. DETAILED DESCRIPTION OF HYDRAULICALLY-DRIVEN FUEL INJECTOR IGNITOR—FIGS. 18-25.

A. DETAILED DESCRIPTION OF FIG. 18.

An alternative and improved form of a fuel injector (FI) which can be employed in four stroke cycle engines in lieu of the FI of FIGS. 1 & 2 and with modified electronic control logic of FIGS. 20 to 25 can be used in two stroke cycle and rotary engines.

Another advantage of the FI of FIG. 18 lies in the use of a plurality of closely spaced open ended concentric cylinders (OEC'S) 510 which are positioned between the base assembly 562 and the fluid manifold head cap (FMH) 626 and are arranged concentrically around rod 512 and are divided into entrance and exit paths by a concentric baffle cylinder ring 542 channeling the E-R fluid passing through by forming a return channel 549 and enabling hydraulic pressure to be applied to the injector rod 512 in one direction while neutralizing the viscous effect during clear passage of the E-R fluid. This hydraulic pressure may be achieved through the use of a positive-displacement, constant-flow hydraulic pump having the capability of producing pressures of the order of 100 to 150 psi. Such state-of-the art pumps are available commercially; pumps used in power steering systems for late model automobiles are one example.

E-R fluid fills the fuel injector body 699 from the fuel supply inlet 612 at the top of the fuel injector to the supporting base 562 at the bottom of the fuel injector and including specifically the spaces between the concentric OEC'S as discussed in more detail below.

When an E-R solidifying voltage 610, as generated by the action of the electronic controller FIG. 25, is supplied to the alternately positioned OEC'S 516 while the remaining OEC'S 514 remain at ground potential, there will result four cylinders of solidified E-R fluid formed between the five OEC'S 510.

It is of significance to note that the solidified E-R fluid between adjacent OEC'S 510 blocks further passage of E-R fluid from the hydraulic pump thereby creating hydraulic pressure in the E-R fluid input chamber 625. This pressure will force the OEC'S 514 and 516 and control body assembly 520 together with rod 512 to move downward, forcing piston 572 into piston cavity 528 pressurizing the fuel in the fuel pressure chamber 530.

When the solidifying voltage is removed from the OEC'S the rod 512 ceases moving further into fuel pressure chamber 530, its pressure is immediately reduced to a level whereby no additional fuel is forced into the combustion chamber 639. Fuel injection is thus terminated. More specifically, when the solidifying voltage is supplied to OEC'S 516, the E-R fluid within the OEC'S spaces becomes solidified. The resulting hydraulic pressure forces the control body assembly 520 including the rod 512 and piston 572 into piston cavity 528 injecting fuel into the combustion chamber.

The termination of fuel injection is controlled solely by removal of the solidifying voltage by the electronic control circuit discussed herein and shown in FIGS. 20 and 25 and particularly in FIG. 25.

Removing the solidifying voltage from the OEC'S 516 allows the spring 540 to force the control body assembly 520 back to the normal position resupplying the pressure chamber through check valve 640 in preparation for the next cycle of operation.

As indicated generally above, fuel injection is initiated when the solidifying voltage is applied to OEC'S 516 and the resulting hydraulic pressure in the inlet chamber 625 forces the piston 572 downward into FPC 530 creating a pressure within FPC 530 and opening poppet valve 546 (FIG. 18) and spraying fuel into CC 639 where it is ignited by contact with the throat of the hot-throated venturi 580.

Rod 512 can be seen to extend downward through OEC'S 514 and 516 and spring 540, which is contained at the bottom end of chamber 570. The rod 512 contains fuel outlet orifices 532 which furnish fuel to the supply/scavenging chamber 618. A check valve 640 is positioned between the supply/scavenging chamber 618 and the high pressure injection chamber 530 to enable resupply of chamber 530 during the return stroke of rod 512.

The poppet nozzle 546 of the high pressure chamber 530 sprays fuel downwardly into the hot-throated venturi tube 580, which functions to mix the fuel and air and ignite them on contact with the hot throat 580 producing burning as the mixture is forced out into the engine combustion chamber. The venturi tube 580 is secured to an insulative ring 588 between the bottom of the mixing chamber and the top of the hot-throated venturi 580 creating air passages to the mixing chamber 533 between the venturi and the opening in the injector base. It is noted that the spoked base element 602 is secured to the injector rod 512 to support anJ to receive the thrust of the OEC'S during injection. The tops of the OEC'S are supported and spaced by insulated spacers 600 to form the control body assembly 520. The high voltage OEC'S 516 are insulated from the bottom supports 602 by insulative spacers 568, and are energized by the sliding contacts 657.

The fuel ignition element incorporated into this invention is a hot-throated venturi 580. This venturi device has a throat which is electrically heated. Its temperature is maintained at a constant value by monitoring the current change in a standard voltage impressed across the heater element.

The entire venturi unit is suspended in the portion of the injector unit which is threaded into the engine cylinder chamber and in a manner which allows the free flow of air around all sides of the unit. The unit is also positioned at the exit port of the injector nozzle causing the diffused spray from the nozzle to pass through the throat, igniting on contact, then exiting into the oxygen rich air compressed in the engine combustion chamber where it completes its burning.

B. DETAILED DESCRIPTION OF FIG. 19

FIG. 19 shows an alternate form of the invention shown in FIG. 18 but having a hydraulically-actuated return instead of a spring return. This alternate form of the invention imposes a high voltage, open ended concentric cylinder (OEC) 616 in the outlet passage of the CBA, which is energized at the completion of the throttle ring count and removal of the solidifying voltage from the inlet passage OEC'S 510. A solidifying voltage is transferred from sliding contact 610 to sliding contact 710, which applies it to the outlet passage 511 (outlined by 616 and adjacent OEC's at ground potential) at cessation of injection, causing the CBA to be driven in the opposite direction. This mechanization results in reaction time fast enough to accommodate the high rpm anticipated in newly developed two stroke cycle engines.

C. to H. DETAILED DESCRIPTION OF FIGS. 20–25.

FIGS. 20–25 are control lo8ic diagrams which are modified versions of the diagrams shown in FIGS. 3, 7, 4, 5, 6 and 9 respectively. These new diagrams incorporate the minor modifications necessary to control these hydraulically-actuated embodiments of the invention, as shown in FIGS. 18 and 19.

While the above specification discloses several preferred embodiments of the invention, it will be apparent to one of ordinary skill in the art that various other modifications and embodiments of the invention can be made without departing from the spirit or scope of the invention as defined in the appended claims.

I claim:

1. An electronically controlled fuel injector for an internal combustion engine having combustion chambers and cmprising:

an unthrottled air intake;

first means for injecting the fuel into a given combustion chamber;

second means for igniting said fuel before it enters said given combustion chamber, so that said fuel is burning as it enters said combustion chamber; and third means for electronically controlling the output power of the engine by electronically regulating the quantity of fuel injected during each injection of fuel into said given combustion chamber.

2. The electronically controlled fuel injector for an internal combustion engine as set forth in claim 1 wherein said first mens for injecting fuel into said given combustion chamber comprises:

hydraulic means for initiating fuel injection into said given combustion chamber; and hydraulic means for terminating fuel injection into said given combustion chamber.

3. A method for injecting fuel into the combustion chambers of an electronically controlled fuel injector type internal combustion engine having pistons and combustion chambers, comprising the steps of:

providing for unthrottled air intake during the piston's air intake stroke;

injecting the fuel into a given combustion chamber;

igniting the fuel before it enters into said given combustion chamber, so that said fuel is burning as it enters said combustion chamber; and electronically controlling the output power of the engine by electronically regulating the quantity of fuel injected into said given combustion chamber during each injection of fuel into said given combustion chamber.

4. A method for injecting fuel into the combustion chambers of an electronically controlled fuel injector type internal combustion engine having pistons and combustion chambers, comprising the steps of:

providing for unthrottled air intake during the piston's air intake stroke;

providing an electrically heated venturi tube incorporated into the injector of each said combustion chamber;

injecting the fuel through each said heated venturi tube and into its associated said combustion chamber;

igniting said injected fuel in said heated venturi tube;

burning said injected fuel in said venturi tube and as it is injected into said given combustion chamber; and electronically controlling teh output power of the engine by regulating the quantity of fuel injected into said given combustion chamber during each injection of fuel into said given combustion chamber.

5. An electronically controlled fuel injector for an internal combustion engine having combustion chambers and comprising:

an unthrottled air intake;

first means for injecting the fuel into a given combustion chamber;

second means for burning said fuel as it enters said given combustion chamber, said second means for burning said fuel comprising a hot-throated venturi device which ignites said fuel before it enters said given combustion chamber;

third means for electronically controlling the output power of the engine by electronically regulating the quantity of fuel injected during each injection of fuel into said given combustion chamber.

6. The electronically controlled fuel injector for an internal combustion engine as set forth in claim 5 wherein aid hot-throated venturi device is an electrically heated venturi tube.

7. An electronically controlled fuel injector for an internal combustion engine having combustion chambers and comprising:

an unthrottled air intake;

first means for injecting the fuel into a given combustion chamber, said first means comprising:

a fuel injector rod;

a plurality of closely-spaced, open-ended cylinders, said cylinders being positioned concentrically around said injector rod so as to form a plurality of enclosed spaces between said open-ended cylinders;

electro-rheological fluid contained within said spaces between said open-ended cylinders;

a concentric baffle cylinder ring, for dividing said space between said open-ended cylinders into entrance and exit paths for said electro-rheological fluid;

a hydraulic pump for pressurizing said electro-rheological fluid;

a source of electric voltage for solidifying said electro-rheological fluid between adjacent open-ended cylinders, causing said fuel injector rod to move downward and thereby start fuel injection; and spring means which act to move said fuel injector rod upward in preparation for the next cycle of operation when said solidifying voltage is removed from said open-ended cylinders; and second means for burning said fuel as it is being injected into said given combustion chamber; and third means for switching on said soure of electric voltage and for electronically controlling the output power of the engine by electronically regulating the quantity of fuel injected during each injection of fuel into said given combustion chamber.

8. an electronically controlled fuel injector for an internal combustion engine having combustion chambers and comprising:

an unthrottled air intake;

first means for injecting the fuel into a given combustion chamber, said first means comprising:

a fuel injector rod;

a plurality of closely-spaced, open-ended cylinders, said cylinders being positioned concentrically around said injector rod so as to form a plurality of enclosed spaces between said open-ended cylinders, said enclosed spaces defining an inlet passage and an outlet passge;

electro-rheological fluid within said spaces between said open-ended cylinders;

a concentric baffle cylinder ring, for dividing said spaces between said open-ended cylinders into entrance and exit paths for said electro-rheological fluid;

a hydraulic pump for pressurizing said electro-rheological fluid;

a first source of electric voltage, for solidifying said electro-rheological fluid in said inlet passage between adjacent open-ended cylinders, causing said fuel injector rod to move downward and thereby start fuel injection; and a second source of electric voltage switched on as said first source is switched off, for solidifying said electro-rheological fluid in said outlet passage between adjacent open-ended cylinders, causing said fuel injector rod to move upward in preparation for the next cycle of operation; and second means for burning said fuel as it is being injected into said given combustion chamber; and third means for sequentially switching on both said sources of electric voltage and for electronically controlling the output power of the engine by electronically controlling the switching time, thereby regulating the quantity of fuel injected during each injection of fuel into said given combustion chamber.

* * * * *